US005318098A

United States Patent [19]

Wagstaff et al.

[11] Patent Number: 5,318,098

[45] Date of Patent: Jun. 7, 1994

[54] METAL CASTING UNIT

[75] Inventors: Robert B. Wagstaff, Veradale; David A. Fort, Spokane; Frank E. Wagstaff, Veradale; Richard J. Collins, Spokane, all of Wash.

[73] Assignee: Wagstaff, Inc., Spokane, Wash.

[21] Appl. No.: 950,148

[22] Filed: Sep. 24, 1992

[51] Int. Cl.[5] ..... B22D 11/124

[52] U.S. Cl. ..... 164/444

[58] Field of Search ..... 164/487, 486, 444, 443, 164/451, 458, 4.1, 150, 414

[56] References Cited

U.S. PATENT DOCUMENTS

| | | | |
|---|---|---|---|
| 4,597,432 | 7/1986 | Collins et al. | 164/444 |
| 4,598,763 | 7/1986 | Wagstaff et al. | 164/444 |
| 4,693,298 | 9/1987 | Wagstaff | 164/444 |
| 4,709,744 | 12/1987 | Bryson et al. | 164/487 |
| 4,947,925 | 8/1990 | Wagstaff et al. | 164/444 |
| 5,040,595 | 8/1991 | Wagstaff | 164/444 |

*Primary Examiner*—Paula A. Bradley
*Assistant Examiner*—Erik R. Puknys
*Attorney, Agent, or Firm*—Christopher Duffy

[57] ABSTRACT

A casting unit 6 consists of a monolithic body which is annular in shape and has an annular flange 72 outturned about the axis and monolithically outstanding on the body at the outer periphery, a set of lugs 110 angularly spaced about the axis on the lower end portion of the body and monolithically outstanding in the aperture, and a circumferential groove 114 about the outer periphery of the body in the upper end portion, with mullions 20 monolithically upstanding therein, adjacent the outer periphery of the groove, to form ports 112.The groove is interconnected with the cavity 108 in the lower end portion of the body at the aperture; and passages, 126, 140, a graphite ring 16, and whatever else is required, are added to complete the unit 6 before it is supported in an aperture in a metal casting table 2, having liquid coolant discharge means 14 circumposed thereabout and a stool to support molten metal after being mated with the lugs. Where the liquid coolant discharge means take the form of a liquid coolant box, the housing 22, 24 of which defines the table, and the casting unit is upwardly inserted in the box, at an aperture 26 in the bottom, and abutted with the top of the chamber 14, a device 17 is provided for sensing leakage between the casting unit and the top of the chamber. The leakage is discharged in a passage 140 passing through one of the mullions to the bottom of the casting unit.

52 Claims, 6 Drawing Sheets

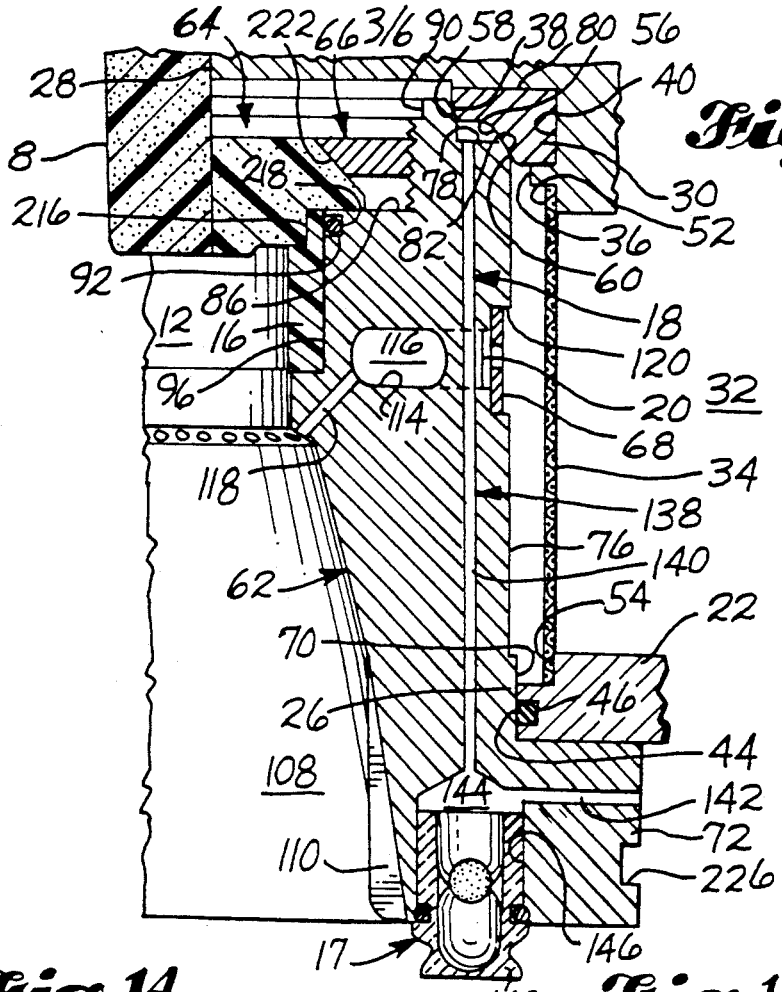
Fig. 3
Fig. 14
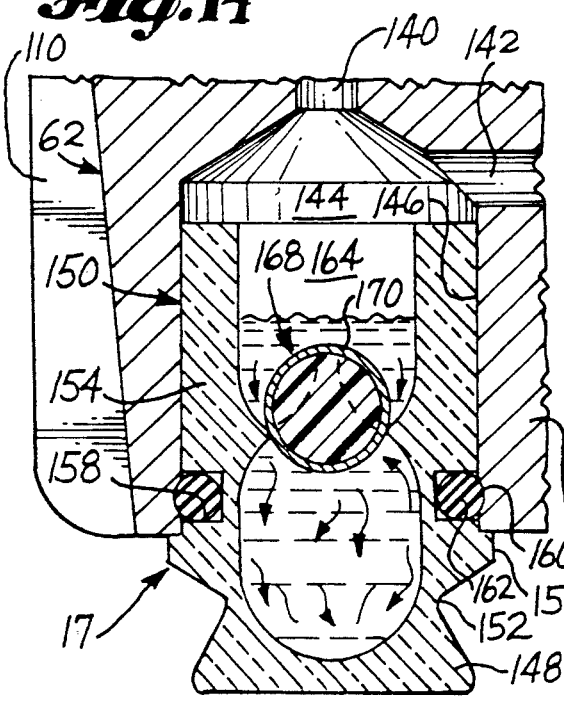
Fig. 15
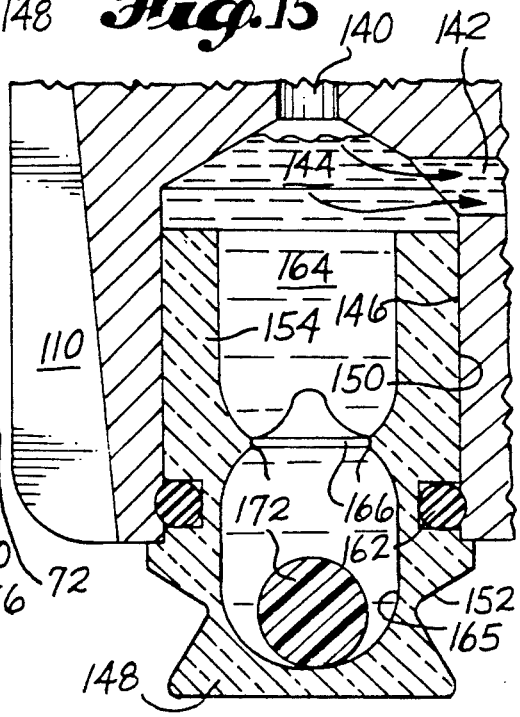

Fig.7
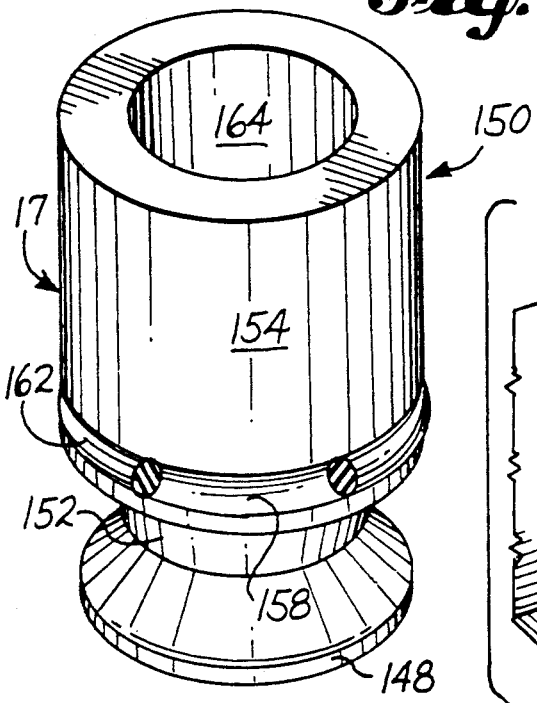
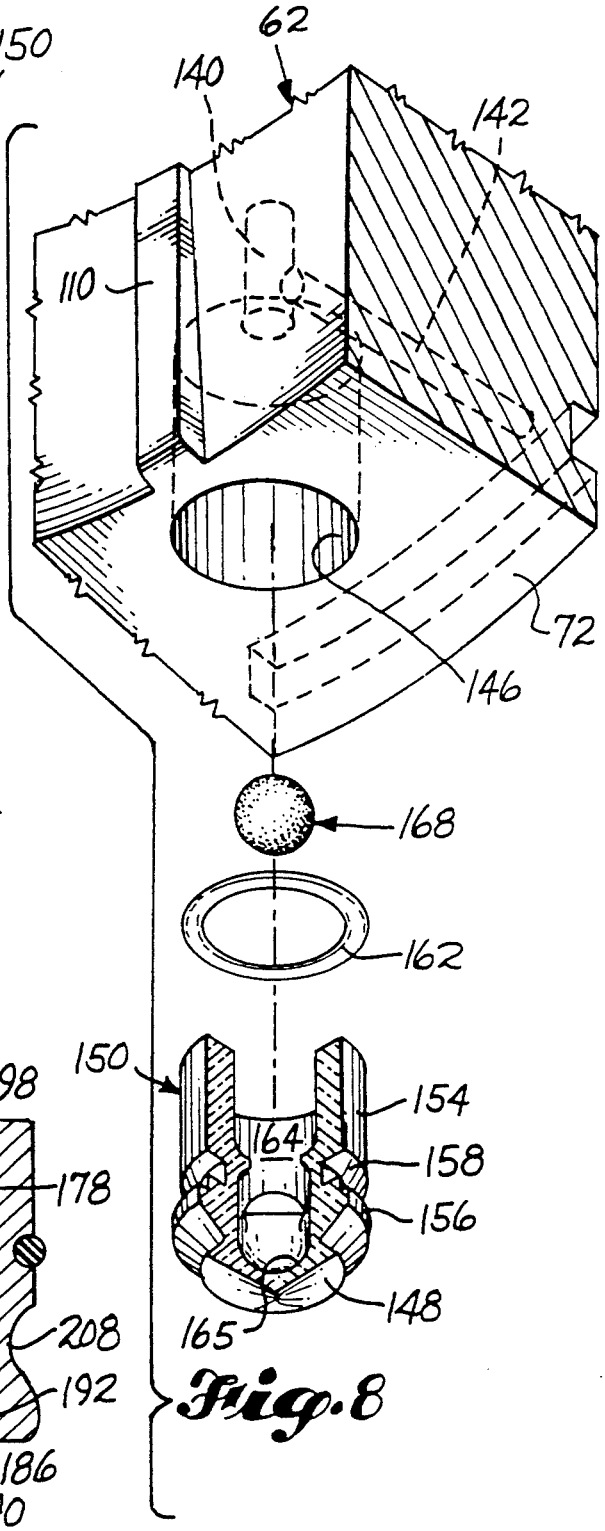
Fig.8
Fig.16
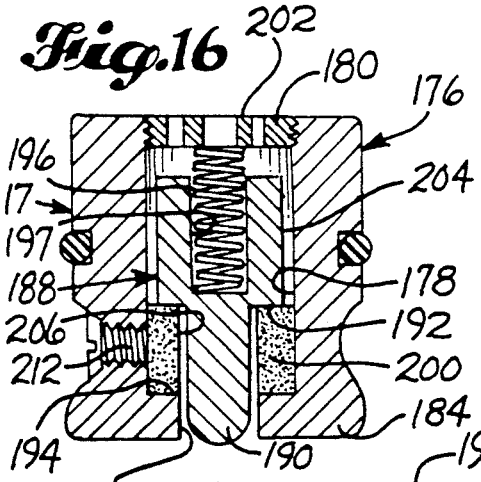
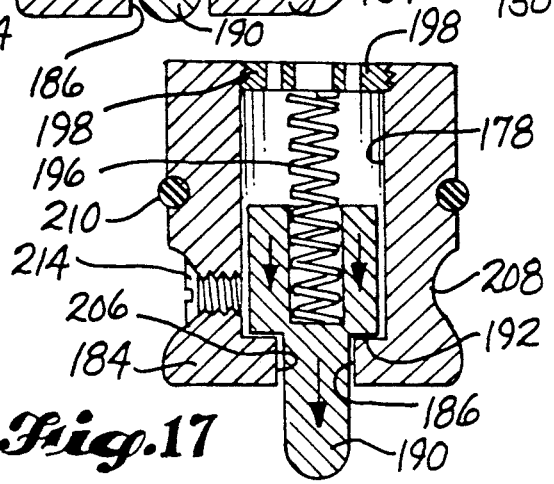
Fig.17

Fig.9
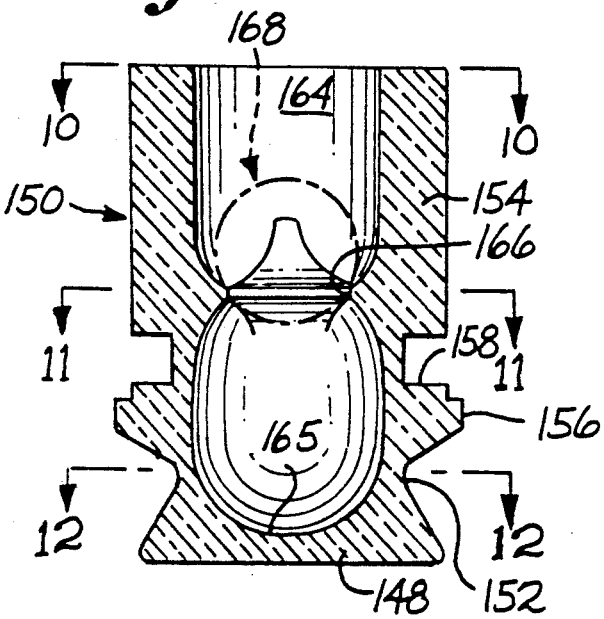
Fig.11
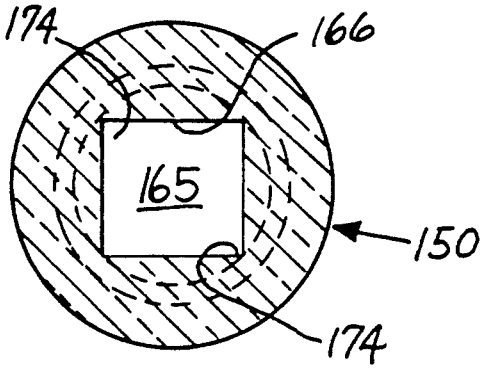
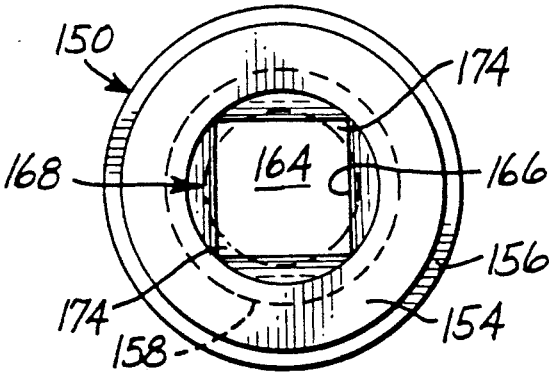
Fig.10
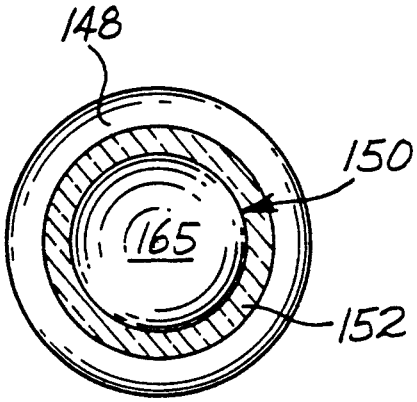
Fig.12
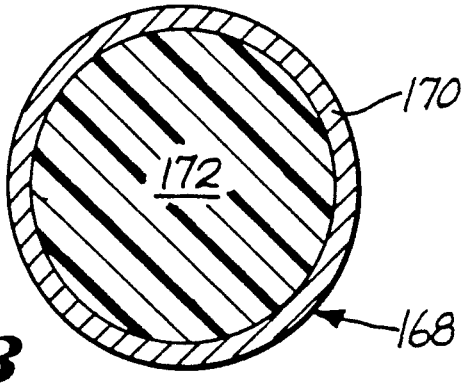
Fig.13

METAL CASTING UNIT

TECHNICAL FIELD

This invention relates to the casting of molten metal, and in particular, to the casting of molten metal in an apparatus of the type wherein an annular metal casting unit is supported in an aperture in a casting table to form an open ended metal casting station thereon through which the molten metal to be cast is poured along a vertical axis of the table and cast into a molten metal body, and wherein during the casting procedure, the casting station has a stool operatively disposed therebelow on the axis of the table to telescopically engage with the bottom of the casting unit at a stage preliminary to the casting operation, and then in the operation itself, to provide a relatively retractable support for the molten metal body as it progressively emerges from the unit and elongates along the axis of the table, and wherein moreover, the metal casting unit has an opening formed therein about the molten metal body, and means formed thereabout in the apparatus for discharging liquid coolant through the opening to direct cool the molten metal body as it emerges from the unit and elongates along the axis of the table.

BACKGROUND ART

Apparatus of this type are widely used in the metal casting industry, and commonly comprise a plurality of metal casting units, all of which are similar in nature but supported at separate apertures in the table on spaced vertical axes thereof. In some apparatus, the liquid coolant discharge means take the form of a separate liquid coolant jacket about each casting unit, and a separate liquid coolant supply for the same; while in other apparatus, the liquid coolant discharge means take the form of a liquid coolant box, the housing of which defines the table and has spaced top and bottom housing members therein, which in turn have pairs of mutually opposing top and bottom apertures therein about spaced vertical axes of the box for the formation of the respective casting stations therebetween, and a chamber in the space between the housing members for supplying liquid coolant to the casting units at all of the respective stations. In each apparatus, each casting unit comprises an annular mold which has a vertical axis, upper and lower ends, an aperture extending therethrough between the ends thereof on the mold axis, an opening extending therethrough between the aperture and the outer periphery of the mold transverse the axis, and an annular flange relatively outturned about the mold axis on the outer periphery of the mold. Each mold is telescopically inserted in the table at the respective aperture or pair of apertures for the same, and coaxially thereof, to form the respective casting station, and is abutted against the table at the flange thereof, to receive support from the table. Moreover, where the liquid coolant discharge means take the form of a liquid coolant box, the housing of which has the aforedescribed features, the flange is commonly outstanding on one end portion of the mold at the outer periphery thereof, and the mold is telescopically inserted in the chamber of the box through the aperture in one of the top and bottom housing members, and abutted against the one housing member at the flange thereof, and against the other housing member about the aperture therein, so that in forming the casting station, the mold interfaces with the chamber at the opening in the mold transverse the axis thereof, for the discharge of the coolant therethrough. The reference in this regard to inserting the mold through the aperture in "one" of the housing members, takes into consideration that, as illustrated in U.S. Pat. No. 4,597,432, the flange may be outstanding on the lower end portion of the mold at the outer periphery thereof, and the mold may be telescopically inserted in the chamber through the bottom aperture of the box, and abutted against the bottom housing member at the flange thereof, and against the top housing member at the upper end portion thereof, so long as means are provided in the abutment interface between the upper end portion of the mold and the top housing member of the box, to form an annular seal between the two. In fact, as described in that Patent, the abutment interface commonly has a pair of annular seals formed thereabout in circumferentially extending lines of the interface which are relatively radially spaced apart from one another about the axis of the box and relatively offset from one another axially of the box, with a port interposed therebetween to intercept any liquid coolant which leaks from the chamber past the relatively radially outer seal of the interface in the direction of the axis of the box, and discharge the leakage coolant from the interface before the leakage coolant can penetrate the relatively radially inner seal thereof.

Some apparatus of the foregoing type also employ a combination wherein each mold is engaged with the table in an annulus about the respective axis of the table, the annulus has a fluid supply connection thereacross between the mold and the table, and the mold has an additional opening in one end portion thereof, and a fluid flow passage therewithin which is interconnected between the fluid supply connection and the additional opening to transmit fluid to the additional opening from the connection for discharge from the mold, relatively outside thereof. In U.S. Pat. Nos. 4,598,763 and 4,947,925, for example, the mold has an annular rabbet about the inner periphery thereof at the upper end thereof, the additional opening is formed in the axially extending wall of the rabbet, and the metal casting unit further comprises a ring of graphite or the like which is seated in the rabbet so that the fluid transmitted through the passage can be forced through the ring in the direction of the axis of the mold, to form an annulus of fluid about the molten metal body as it is cast within the aperture of the mold. See also U.S. Pat. Nos. 4,693,298, 5,040,595, and 5,119,883, wherein one or more fluids are transmitted through the body of the mold for carrying out still other functions in connection with the casting operation performed by the molds described therein.

DISCLOSURE OF THE INVENTION

Heretofore, each casting unit has employed an annular mold comprising a composite of two or more annular components which were separately made and then joined together to form the mold as a whole, or perhaps to form a suitable transverse opening therethrough, such as an annular slot, or perhaps to form a flange outturned thereabout. The making of the individual components of the mold, and the assembly of them thereafter, was labor intensive and costly in material, since each component had to be configured to mate with the others, as well as to provide the necessary rabbets, holes and other recesses therein for the mold. This involved considerable machining and the discard of considerable material. In addition, the mold also had to be given sufficient body between the inside and outside diameters thereof, to withstand the temperature cycling it would undergo in the casting operation, yet not so much body as to defeat the limited heat transfer function of it in the apparatus. To design and machine the respective components to achieve all of these purposes was costly both in material and in labor, as indicated.

Moreover, it has become the preferred practice to provide for discharging the coolant onto the molten metal body through a series of closely spaced holes which are arranged about the axis of the mold so that the coolant discharges as a corresponding series of jets which have, or are amended with air to have heat transfer characteristics at the surface of the molten metal body that differ from what the coolant would have if it were discharged from an annular slot. The machining of this series of holes in a component of the mold before it was assembled with other components, has required that the component have sufficient body of material to withstand the stress of the machining operation, and this in turn has influenced the design and machining of the respective components otherwise, particularly if the mold were to have an acceptable outside diameter.

We have found that the mold can be made more economically, and can be given more substantiality of material, and more ruggedness, at minimum diameter, including for temperature cycling purposes, and for hole forming purposes, if (1) it is cast or otherwise formed as a monolithic body of mold forming material having a vertical axis, upper and lower ends, and an aperture between the ends thereof on the mold body axis; and if (2) when so formed, the mold body has an annular (including partannular) flange relatively outturned about the axis thereof, which is monolithically outstanding in the same material at the outer periphery of the mold body to abut the table when the mold body is telescopically inserted in the table at the respective aperture or pair of apertures for the same, coaxially thereof, to form the casting station; and if moreover, (3) the mold body has angularly spaced guide means about the axis thereof, which are monolithically outstanding in the same material on the lower end portion of the mold body in the aperture thereof, to mate with the stool in the stage preliminary to the casting operation, and (4) the mold body has angularly spaced ports about the axis thereof, which are recessed in the outer periphery of the mold body to interface with the liquid coolant discharge means, and to open into the aperture of the mold body between the guide means and the upper end portion of the mold body during the casting operation, so that the liquid coolant discharges through the ports into the lower end portion of the mold body to direct cool the molten metal as it emerges from the upper end portion of the mold body and elongates along the axis thereof.

In many of the presently preferred embodiments of the invention, the mold body also has an annular passage therein which extends about the axis of the mold body in the outer peripheral portion thereof, and a series of openings in the inner peripheral portion thereof, which extend about the axis of the mold body to interconnect the passage with the aperture thereof between the guide means and the upper end portion of the mold body, and in these embodiments, the ports open into the annular passage to discharge the liquid coolant onto the molten metal body through the series of openings in the inner peripheral portion of the mold body.

In fact, in certain of the presently preferred embodiments of the invention, the mold body has a first annular surface extending about the outer periphery thereof which interfaces with the liquid coolant discharge means, and second and third annular surfaces which extend about the axis of the mold body at the inner peripheries of the upper and lower end portions of the mold body, respectively, the second of which annular surfaces extends generally parallel to the axis of the mold body and defines an open ended upper cavity in the aperture thereof, having a cross sectional configuration in first planes transverse the axis of the mold body corresponding to the cross sectional configuration of the molten metal body to be cast therein, and the third of which annular surfaces defines an open ended lower cavity in the aperture of the mold body, having a cross sectional configuration in second planes transverse the axis of the mold body corresponding to the cross sectional configuration of the upper cavity, but greater in cross sectional area than that of the upper cavity in each of said second planes, so as to flare relatively outwardly from the axis of the mold body in the direction relatively toward the lower end thereof from the upper end thereof, and provide an annulus of open air about the molten metal body as it emerges from the upper cavity and elongates along the axis of the mold body in the lower cavity. The guide means take the form of a set of angularly spaced lugs which are monolithically outstanding on the third annular surface in the same material, to mate with the stool in the stage preliminary to the casting operation, and the series of ports is formed by a circumferential groove in the outer peripheral portion of the mold body at the first annular surface thereof, which has a series of mullions that are angularly spaced about the groove and monolithically axially upstanding therein of the same material, to form the ports. Preferably, the mullions are also radially outwardly spaced from the bottom of the groove to leave an annular channel about the axis of the mold body between the mullions and the bottom of the groove. For the reasons indicated, the mold body preferably also has a series of closely spaced holes in the inner peripheral portion thereof, which extend about the axis of the mold body to interconnect the channel with the lower cavity in the aperture thereof, for the discharge of the liquid coolant onto the molten metal body from the mold body. In some embodiments, the groove is formed in the upper end portion of the mold body, and the series of holes is sharply angled downwardly therefrom in the general direction of the axis of the mold body.

Depending on the cross sectional configuration of the molten metal body to be cast in the mold body, the three annular surfaces of the mold body may have varying cross sectional configurations. In the apparatus described hereinafter with respect to the accompanying drawings, the first and second annular surfaces of the mold body are cylindrical, and the third annular surface thereof is comprised of an axially extending series of conical sections, the uppermost of which has the series of closely spaced holes opening therein, and the lowermost of which has the set of angularly spaced lugs monolithically outstanding thereon.

As before, the mold body may be engaged with the table in an annulus about the axis of the table, the annulus may have a fluid supply connection thereacross between the mold body and the table, and the mold body may have an additional opening in one end portion thereof, and a fluid flow passage therewithin which is interconnected between the fluid supply connection and the additional opening to transmit fluid to the additional opening from the connection for discharge from the mold body, relatively outside thereof. Also, as before, the annulus may be formed about the axis of the table at the abutment interface between the flange and the table.

However, in accordance with the invention, the ports in the mold body are defined by outer peripheral portions thereof which monolithically upstand in the same material between the upper and lower end portions of the mold body, generally axially thereof, and the fluid flow passage extends through one of the port defining outer peripheral portions of the mold body, axially thereof.

As before, moreover, the liquid coolant discharge means may take the form of a liquid coolant box, the housing of which defines the table and has spaced top and bottom housing members therein, which in turn have a pair of mutually opposing top and bottom apertures therein about a vertical axis of the box, for the formation of the casting station therebetween, and a chamber in the space between the members for supplying liquid coolant to the casting unit at the station. In such a case, and in accordance with the invention, the flange is monolithically outstanding in the same material on one end portion of the mold body at the outer periphery thereof, and the mold body is telescopically inserted in the chamber of the box through the aperture in one of the top and bottom housing members, and abutted against the one housing member at the flange thereof, and against the other housing member about the aperture therein, so that in forming the casting station, the mold body interfaces with the chamber at the ports in the outer periphery thereof, for the discharge of the chamber coolant therethrough.

Additionally, and as before, the flange may be monolithically outstanding in the same material on the lower end portion of the mold body at the outer periphery thereof, the mold body may be telescopically inserted in the chamber through the bottom aperture of the box, and abutted against the bottom housing member at the flange thereof, and against the top housing member at the upper end portion thereof, and the fluid supply connection may be formed in the abutment interface between the upper end portion of the mold body and the top housing member of the box, as in U.S. Pat. No. 4,597,432. However, in accordance with the invention, the additional opening is formed in the lower end portion of the mold body, and the abutment interface between the upper end portion of the mold body and the top housing member of the box has a pair of annular seals formed thereabout in circumferentially extending lines of the interface which are relatively radially spaced apart from one another about the axis of the box and relatively offset from one another axially of the box, with the fluid supply connection interposed therebetween to intercept any liquid coolant which leaks from the chamber past the relatively radially outer seal of the interface in the direction of the axis of the box, and discharge the leakage coolant in the direction of the additional opening in the lower end portion of the mold body, before the leakage coolant can penetrate the relatively inner seal of the interface.

In certain of the presently preferred embodiments of the invention, the mold body has an annular rabbet about the outer periphery thereof at the upper end thereof, to form a pair of annular shoulders about the rabbet and the upper end of the mold body, and the top housing member of the box has an annular seal of elastomeric material circumposed about the axis thereof adjacent the top aperture therein, which is engaged with the annular shoulders about the rabbet and the upper end of the mold body, to form the pair of annular seals about the interface between the upper end portion of the mold body and the top housing member of the box. In addition, the elastomeric seal has an annular swale about the inner periphery thereof, at the lower end thereof, to leave an annular clearance between the elastomeric seal and the step of the rabbet, and the fluid supply connection is formed in the step of the rabbet opposite the swale to intercept liquid coolant which leaks across the seal between the elastomeric seal and the shoulder of the rabbet, before the leakage can penetrate the seal between the elastomeric seal and the shoulder on the upper end of the mold body.

Often, in all of the embodiments of the invention wherein the liquid coolant discharge means take the form of a liquid coolant box, the box has an annular screen circumposed about the axis thereof at the outer periphery of the casting station, to screen the liquid coolant discharging through the ports of the mold body from the chamber of the box.

Furthermore, the metal casting unit usually further comprises an annular baffle which is sleeved about the series of ports in the mold body and has a series of holes symmetrically arrayed thereabout to meter the coolant flow into the ports from the chamber.

In making the annular mold for the casting unit, a monolithic body of mold forming material is cast or otherwise formed to have a vertical axis, upper and lower ends, an aperture between the ends thereof on the mold body axis, an annular flange which is relatively outturned about the mold body axis, and monolithically outstanding in the same material at the outer periphery of the mold body to abut the table when the mold body is inserted in the aperture of the table coaxially thereof, to form the station, and to receive support from the table, as well as angularly spaced guide means about the axis of the mold body, which are monolithically outstanding in the same material on the lower end portion of the mold body in the aperture thereof, to mate with the stool in the stage preliminary to the casting operation, and angularly spaced ports about the axis of the mold body, which are recessed in the outer periphery of the mold body to interface with the liquid coolant discharge means in the apparatus during the casting operation. Simultaneously, or thereafter, such as through a post machining operation, the ports are opened into the aperture of the mold body between the guide means and the upper end portion of the mold body, so that the liquid coolant can discharge through the ports to direct cool the molten metal body as it emerges from the upper end portion of the mold body and elongates along the axis thereof during the casting operation.

Typically, the mold body is formed to have the aforementioned annular passage therein which extends about the axis of the mold body in the outer peripheral portion thereof, and the ports are opened into the aperture of the mold body by both forming a series of openings in the inner peripheral portion of the mold body, which extend about the axis of the mold body to interconnect the annular passage with the aperture between the guide means and the upper end portion of the mold body, and connecting the ports to the annular passage to discharge the liquid coolant onto the molten metal body through the series of openings in the inner peripheral portion of the mold body. Commonly, however, the mold body is formed with the ports connected to the annular passage, and then the series of openings is thereafter formed in the inner peripheral portion of the mold body to interconnect the passage with the aperture of the mold body.

Preferably, the mold body is formed to have the three aforementioned annular surfaces thereon, the set of angularly spaced lugs on the third annular surface, and the circumferential groove in the outer peripheral portion of the mold body at the first annular surface, with the series of mullions monolithically upstanding therein. The mullions are also preferably formed so as to be radially outwardly spaced from the bottom of the groove as indicated, and the ports are opened into the aperture of the mold body by forming a series of closely spaced holes in the inner peripheral portion of the mold body, which extends about the axis of the mold body to interconnect the annular channel between the mullions and the bottom of the groove, with the lower cavity in the aperture of the mold body. Furthermore, the groove is preferably formed in the upper end portion of the mold body, and the series of holes is sharply angled downwardly therefrom in the general direction of the axis of the mold body. In the embodiment described hereinafter in reference to the accompanying drawings, the first and second annular surfaces are formed to be cylindrical, and the third is formed to comprise an axially extending series of conical sections, the uppermost of which has the series of closely spaced holes opening therein and the lowermost of which has a series of lugs outstanding thereon.

In making the mold, moreover, it is also common practice to form an annular rabbet about the groove, at the outer peripheral edges thereof, to receive an annular baffle which, in forming the metal casting unit, is seated in the rabbet, with symmetrically spaced apertures thereabout to meter the coolant flow into the groove from the liquid coolant discharge means when the mold is inserted in the aperture of the table to form the casting station.

Where the mold body is to receive a ring of graphite or the like in forming the metal casting unit, the method further comprises forming an annular rabbet about the inner periphery of the mold body, at the upper end thereof, to receive the ring. Where air or some other gas it to be forced through the ring, a fluid flow passage is formed in the mold body, which opens at one end into the abutment face of the flange, and at the other end into the rabbet at the axially extending wall thereof. In forming it, moreover, the passage is commonly passed through one of the mullions, axially of the mold body.

Where the flange is monolithically outstanding on the lower end portion of the mold body at the outer periphery thereof, an annular rabbet may be formed about the outer periphery of the mold body at the upper end thereof, to provide the aforementioned pair of annular abutments about the axis of the mold body on the annular shoulders about the rabbet and the upper end of the mold body, for sealing engagement with a corresponding pair of annular seals on the table which are relatively radially spaced apart from one another about the axis of the table, and relatively offset from one another axially of the table, when the mold body is telescopically inserted in the aperture of the table coaxially thereof.

We have also found that where, as in U.S. Pat. No. 4,597,432, an annular metal casting unit with an annular flange relatively outturned thereabout is inserted in a liquid coolant box to form an open ended metal casting station about a vertical axis of the box, and the box has top and bottom plate-like housing members, a chamber for the liquid coolant between the housing members, and mutually opposing top and bottom apertures in the members on the axis, and the annular casting unit is telescopically inserted in the chamber through the bottom aperture in the box, abutted against the bottom housing member at the flange thereof, and engaged with the top housing member in an annulus about the top aperture therein, and means are provided in the annulus to form a pair of annular seals thereabout in circumferentially extending lines of the annulus which are relatively radially spaced apart from one another about the axis of the box and relatively offset from one another axially of the box, the combination can be improved by forming an opening in the lower end portion of the metal casting unit, a port in the upper end portion of the casting unit which opens into the annulus between the annular seals formed thereabout, and a fluid flow passage in the metal casting unit which is interconnected between the port and the opening thereof to discharge to the opening, liquid coolant that leaks from the chamber past the relatively radially outer seal of the annulus in the direction of the axis of the box, before the leakage coolant can penetrate the relatively radially inner seal of the annulus. This makes it possible to use that inner peripheral edge portion of the top housing member which defines the top aperture therein, as a means for forming a cover over the port, so that molten metal cannot penetrate the annulus and contaminate the metal casting unit. Refer for example, to the aforementioned embodiments of the apparatus where the annular mold of the casting unit had an annular rabbet about the outer periphery thereof at the upper end thereof, to form a pair of annular shoulders about the rabbet and the upper end of the casting unit, and the top housing member of the box had an annular seal of elastomeric material circumposed about the axis thereof adjacent the top aperture therein, which engaged with the annular shoulders about the rabbet and the upper end of the casting unit, to form a pair of annular seals about an annulus between the upper end portion of the casting unit and the top housing member of the box, the elastomeric seal having an annular swale about the inner periphery thereof, at the lower end thereof, to leave an annular clearance between the elastomeric seal and the step of the rabbet, and the fluid supply connection or port of the casting unit being formed in the step of the rabbet to intercept liquid coolant which leaked across the seal between the elastomeric seal and the shoulder of the rabbet, before the leakage could penetrate the seal between the elastomeric seal and the shoulder on the upper end of the casting unit.

Furthermore, we have found that the combination may be improved still further by providing leakage coolant detection means in the casting station for sensing the presence of leakage coolant flow in the passage of the casting unit, and communicating the same to an operator of the apparatus. In this way, the presence of the leakage can be made known to the operator, so that he can correct the matter before undertaking, or continuing with the casting operation.

In certain of the presently preferred embodiments of the invention, the leakage coolant detection means include a leakage coolant receptacle which is mounted on the apparatus adjacent the casting station, and has a transparent window therein which is exposed relatively outside of the apparatus for viewing by an operator thereof. The detection means also include means which define a shunt in the passage for sidetracking a portion of the leakage coolant flow to the receptacle, and indicator means whereby the presence of the sidetracked portion of the leakage coolant flow in the receptacle is made visually apparent to the operator through the window of the receptacle.

Several approaches are taken in this regard. In some embodiments, the indicator means include means of changeable color which are interactive with the sidetracked portion of the leakage coolant flow to change color in the window of the receptacle. In certain of them, the changeable color means are liquid coolant soluble, to dissolve in the sidetracked portion of the leakage coolant when interacting with the same.

In many embodiments, the receptacle has an axis, a bore of predetermined diameter with opposing ends which are disposed on the axis of the receptacle and relatively proximal to and remote from the shunt, respectively, and a relatively reduced diameter throat which is disposed in the relatively remote end of the bore transverse the axis of the receptacle and opens onto the window of the receptacle. The proximal end of the bore is connected with the shunt to receive the sidetracked portion of the leakage coolant flow, and the indicator means are disposed in the bore and responsive to the presence of the side tracked portion of the leakage coolant flow therein, to pass through the throat and appear at the window of the receptacle with the flow.

Once again, the indicator means may also include means of changeable color which are interactive with the sidetracked portion of the leakage coolant flow to change color, and in addition, pass through the throat and appear at the window of the receptacle with the flow. Also, the changeable color means may be liquid coolant soluble to dissolve in the sidetracked portion of the flow when interacting therewith, and then flow through the throat with the sidetracked portion of the flow as an additive thereto.

In some embodiments, the receptacle has a portion thereof which projects relatively outside the apparatus on the axis of the receptacle, with the window therein for viewing by the operator of the apparatus, and the relatively projecting portion of the receptacle has a cavity therein on the opposite side of the throat from the bore to receive the indicator means when the same passes through the throat. In one group, moreover, the indicator means include a signaling device which is responsive to the presence of the sidetracked portion of the leakage flow in the bore, to pass through the throat and occupy the cavity of the receptacle for viewing by the operator through the window thereof.

In other embodiments, the receptacle has an end thereof which is exposed to the outside of the apparatus for viewing by the operator thereof, with the window therein on the axis of the receptacle, the throat opens to atmosphere at the window of the receptacle, and the indicator means include a signaling device which is responsive to the presence of the sidetracked portion of the leakage coolant flow in the bore to project through the throat relatively outside the end of the receptacle at the window, for viewing by the operator.

In one particular group of embodiments, the indicator means include a signaling device which is movably disposed in the bore of the receptacle to pass through the throat in the direction of the window of the receptacle, and biasing means are interposed between it and the proximal end of the bore, to urge the device along the axis of the receptacle in the direction of the window of the receptacle when the sidetracked portion of the leakage coolant flow is received in the bore. However, restrainer means are interposed between the signaling device and the remote end of the bore, to restrain it from passing through the throat in the direction of the window of the receptacle when the bore is devoid of leakage. But the restrainer means are soluble in the liquid coolant to dissolve therein when the leakage coolant flow is received in the bore, so that the biasing means can displace the signaling device along the axis of the receptacle to the extent that the device passes through the throat in the direction of the window of the receptacle.

In some embodiments of this latter group, the signaling device takes the form of a ball which is coated with a liquid coolant soluble material that operates to restrain it from passing through the throat when the bore is devoid of leakage coolant, but dissolves in the leakage coolant flow when it is received in the bore, to enable the ball to pass through the throat under the bias of the leakage coolant itself, and appear at the window of the receptacle. In other embodiments of the group, the signaling device takes the form of a piston which has a pin thereon that is disposed to project through the throat and appear at the window of the receptacle, and moreover, is urged by a spring caged between the piston and the proximal end of the bore, to pass the pin through the throat to the extent that it will project relatively outside the apparatus at the window of the receptacle. Circumposed about the pin in the bore, however, is a sleeve which operates to restrain the piston from passing the pin through the throat to that extent, but is soluble in the leakage coolant to dissolve and thereby allow the spring to displace the piston to the extent that the pin will pass through the throat and project as indicated at the window of the receptacle.

One advantage of the invention when an apparatus is equipped with a leakage coolant detection means, is that the table may be pivotally mounted above the top of a casting pit, to be swung into a horizontal position over the pit for the casting operation, or swung up and away from the top of the pit to a position wherein the bottom of the table is more readily observable; and when the table is so mounted and swung up and away from the top of the pit, the various indicator means for signaling the presence of leakage in a casting unit, will remain perceptible to an operator of the apparatus, to the same extent as when the table was in the horizontal position on the top of the pit.

BRIEF DESCRIPTION OF THE DRAWINGS

These features will be better understood by reference to the accompanying drawings wherein certain of the presently preferred embodiments of the invention are illustrated in the context of an apparatus wherein the liquid coolant discharge means take the form of a liquid coolant box, the housing of which defines a table which is pivotally mounted over the top of the pit, and the casting stations of which are formed by bottom loaded metal casting units which are equipped with separate receptacletype leakage detection devices that are mounted in turn on the bottoms of the metal casting units themselves.

In the drawings:

FIG. 3 is a vertical cross section of the casting station along the line 3—3 of FIG. 1;

FIG. 7 is a perspective view of a ball equipped receptacle-type leakage detection device which may be employed on the metal casting unit;

FIG. 8 is an exploded view of the ball equipped receptacle-type leakage detection device when it is vertically mounted on the bottom of the metal casting unit;

FIG. 9 is a vertical cross section of the receptacle in the leakage detection device at the vertical axis thereof;

FIG. 10 is a horizontal cross section of the receptacle along the line 10—10 of FIG. 9;

FIG. 11 is a horizontal cross section of the receptacle along the line 11—11 of FIG. 9;

FIG. 12 is a horizontal cross section of the receptacle along the line 12—12 of FIG. 9;

FIG. 13 is a cross section of the liquid coolant soluble coated ball employed in the receptacle;

FIG. 14 is a vertical cross section of the ball equipped receptacle-type leakage detection device when the device is mounted on the metal casting unit and the ball of the same is in the normal position thereof in the receptacle, but subjected to leakage from the unit;

FIG. 15 is a similar cross section of the ball equipped receptacle-type leakage detection device when the coating of the ball has dissolved in the leakage coolant, and the ball has dropped into the cavity of the projecting portion of the receptacle;

FIG. 16 is a vertical cross section of a piston equipped receptacle-type leakage detection device which may be employed on the metal casting unit in lieu of the ball equipped type, and when the device is in the normal state thereof; and FIG. 17 is a similar cross section of the alternative device when it has been subjected to leakage coolant flow and activated by dissolution of the leakage coolant soluble sleeve therein, to project the pin of the piston therefrom.

BEST MODE FOR CARRYING OUT THE INVENTION

Figure 1:
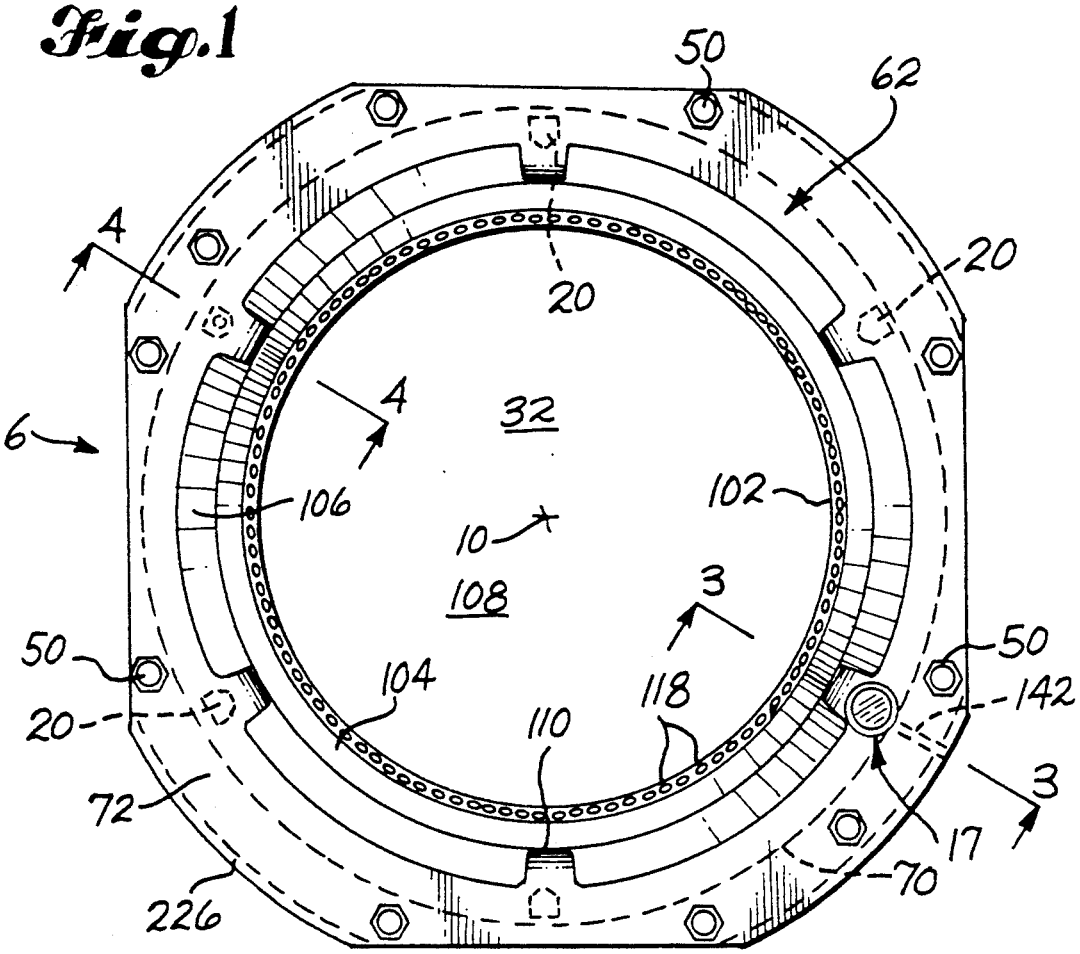
FIG. 1 is a bottom plan view of the metal casting unit employed in forming one casting station of the table.
Figure 5:
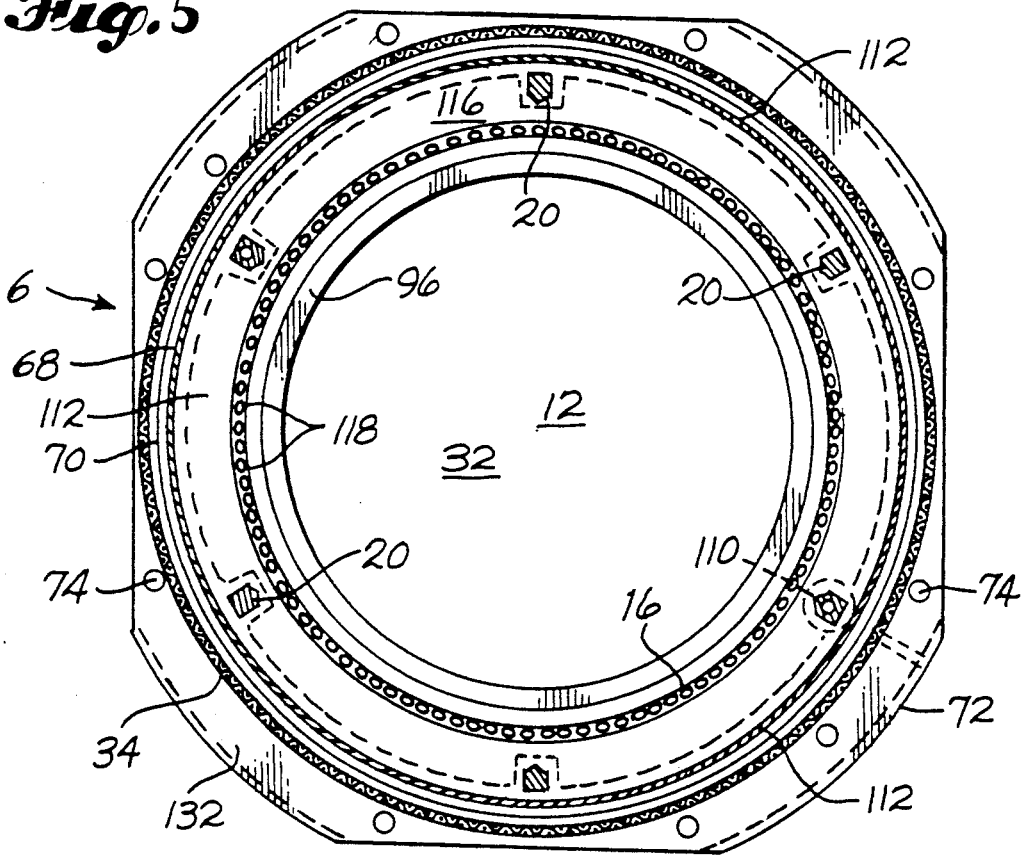
FIG. 5 is a horizontal cross section of the metal casting unit along the line 5—5 of FIG. 2.
Figure 2:
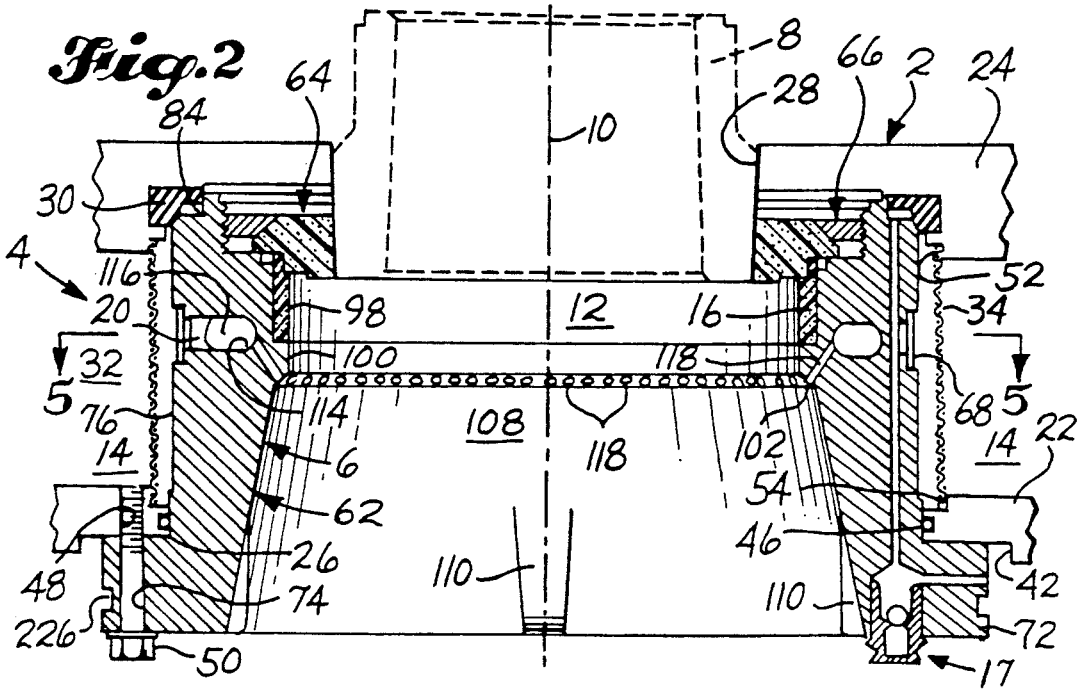
FIG. 2 is a vertical cross section of the casting station along the line 2—2 of FIG. 1.

In referring to the drawings, it will be seen that only so much of the table 2 is shown as to illustrate one casting station 4 of the table, in that the rest of the stations are the same as that shown. Moreover, in FIGS. 1 and 5, only the metal casting unit 6 at that station is shown, inasmuch as showing the table around it does not add materially to an understanding of the invention. Nor is the pit shown in FIG. 2; nor the hot top which is commonly superimposed on the table for the dispensing of molten metal to the respective casting stations 6 thereof. However, the molten metal is dispensed at each station through a scupper depending within the casting unit 6 of the station, and the scupper for the illustrated station is shown in phantom at 8 in FIG. 2. And lastly, during the casting procedure, each casting station 4 has a stool cap operatively disposed therebelow on the vertical axis 10 of the table at that station, to telescopically engage with the bottom of the respective casting unit at a stage preliminary to the casting operation, and then in the operation itself, to provide a relatively retractable support for the molten metal body which is cast at the station, as the molten metal body progressively emerges from the casting unit and elongates along the axis of the station. But to simplify the drawings, this too is not shown in FIG. 2 or elsewhere in the drawings.

By way of an overview of the casting operation itself, molten metal dispensed in the scupper 8, takes shape on the cap of the stool in the upper cavity 12 of the casting unit, and then "stands" on the cap as a body of molten metal which has a thin outer shell of relatively solidified metal therearound, and gradually assumes an ever increasingly solidified state itself, as the cap is relatively retracted from the table in the direction downwardly of the axis 10 of the station to form an elongated body of solid metal known as billet. Meanwhile, liquid coolant such as water is discharged onto the outer shell of the molten metal body by means 14 therearound, to direct cool the body and accelerate its rate of solidification on the cap. Also, in accordance with U.S. Pat. Nos. 4,598,763 and 4,947,925, each casting unit is equipped with a graphite ring 16 about the casting surface thereof in the cavity 12, and during the casting operation, air and oil are forced through the ring to form an oil encompassed annulus of air about the molten metal body as it is cast within the cavity. Additionally, bearing in mind that each casting unit is bottom loaded in the table, and consistent with U.S. Pat. No. 4,597,432, and the invention herein, provision is made for sealing the top of each casting unit with the top of the table in such as way that any leakage tending to flow inward of the axis 10 of the table from the liquid coolant discharge means 14, is intercepted and discharged—not at the top of the table, as in the Patent—but at the bottom of the table, where in addition, its presence is made known to an operator by a leakage detection device 17 mounted on the unit. The fluid transmission system for this latter function is seen generally at 18 in FIG. 3; and the fluid transmission system for the earlier mentioned function by which an oil encompassed annulus of gas is formed about the molten metal body as it is cast within the cavity 12, is seen generally at 19 in FIG. 4. Each system transmits the fluid to its delivery point through one or more outer peripheral portions 20 of the casting unit, as shall be explained more fully hereinafter. And the fluid transmission systems for any additional functions, such as those described in U.S. Pat. Nos. 4,693,298, 5,040,595, and 5,119,883, might also transmit the fluid in similar fashion, but again, to simplify the drawings, only the systems 18 and 19 are shown as representative of the manner in which the outer peripheral portions 20 of the casting unit function for this purpose.

Referring now to more specific features of the apparatus, it will be seen that the liquid coolant discharge means 14 take the form of a liquid coolant box, the housing of which defines the table 2 and has a pair of spaced top and bottom housing members 22, 24 therein which are plate-like in nature. The plate-like housing members in turn have a pair of mutually opposing top and bottom apertures 26, 28 therein about the vertical axis 10 of each casting station 4 in the box 2, for the formation of the respective station therebetween, and a chamber 14 in the space between the housing members for supplying liquid coolant such as water, to all of the casting units at the respective stations. The apertures 26, 28 are relatively larger and smaller than one another in the bottom to top direction of the table, and in accordance with U.S. Pat. No. 4,597,432, each casting unit 6 is telescopically inserted in the chamber through its corresponding bottom aperture 26 of the box, and is abutted against the bottom housing member 22 at a flange 72 thereabout, and against the top housing member 24 at the upper end portion thereof. Furthermore, at the annulus about the top aperture 28, where the upper end portion of the casting unit engages the top housing member 24, the top aperture has an annular gland 30 of elastomeric material thereabout, which forms a pair of annular seals with the upper end portion of the casting unit, that have a connection therebetween to the fluid transmission system 18, so that any leakage through the relatively radially outer seal is intercepted and discharged from the apparatus, at the bottom thereof, as shall be explained more fully hereinafter. This assures that the casting unit remains water tight across the vertical gap 32 between the housing members, so that water in the chamber 14 can penetrate the casting unit only as intended, through an annular screen 34 circumposed about the station at the outer periphery thereof.

Turning again to FIGS. 3 and 4, it will be seen that the top aperture 28 of the box has an annular rabbet 36 about the inner peripheral edge thereof, and the rabbet 36 is rabbetted again at 38, and routed to a still wider diameter at the vertical wall thereof, so as to have a circumferential groove 40 thereabout which forms an annular seat for the elastomeric gland 30 at the top of the gap 32. The bottom aperture 26 of the box has a wide annular rabbet 42 (FIG. 2) about the outer peripheral edge thereof, as well as a circumferential groove 44 (FIG. 3) about the vertical wall thereof, for an elastomeric O-ring 46 which acts as a bottom seal for the casting unit when it is mounted in the box. In addition, threaded holes 48 are formed in the rabbet 42 of the bottom aperture, for cap screws 50 which are used in securing the casting unit to the box. And at the inner peripheral edges of their respective apertures 26, 28, the top and bottom housing members 22, 24 are rabbetted further, at corresponding radii of the axis 10, to provide a pair of annular seats 52, 54 for the screen 34 which is circumposed about the casting station.

The screen 34 is a band of expanded metal, cut into a C-shaped configuration endwise thereof, so that it can be pinched together with its ends overlapping one another, and then released within the gap 32 between the apertures 26, 28, to expand into engagement with the seats 52, 54 of the housing members. The gland 30, on the other hand, has a continuous construction circumferentially thereof, and is adapted to engage elastically within the groove 40 at the top of the gap, and to surround the uppermost rabbet 38 therein. In addition, for purposes of providing the pair of annular seals mentioned earlier, the gland 30 is deeply chamfered and contoured at the inner peripheral edge of its lower end, so that the corner at that end has an annular swale 56 therein, which in turn has rounded crests 58, 60 (FIG. 4) at the upper and lower ends thereof, respectively. These crests function as a pair of annular seals which are both radially and axially spaced apart from one another, in accordance with U.S. Pat. No. 4,597,432, so that leakage past the relatively radially outer seal 60, can be intercepted and discharged within the system 18, as shall be explained more fully hereinafter.

Turning now to the casting unit 6, it will be seen that it comprises an annular mold 62, a refractory top ring 64 which is seated on the mold, and a retainer ring 66 which is threaded within the mold, and about the top ring to clamp the top ring to the mold. The casting unit also comprises the graphite ring 16 and the leakage detection device 17 mentioned earlier, and in addition, an annular baffle 68 which is engaged about the waist of the annular mold, to meter the coolant flow therethrough, as shall be explained more fully hereinafter.

The mold 62 itself is formed as a monolithic body of mold forming material such as metal, with a relatively outturned, part truncated flange 72 about the outer periphery thereof, which is monolithically outstanding on the lower end portion of the mold. Above the flange, the mold is adapted at the outer peripheral outline 70 thereof, to be telescopically insertable in the aperture 26 at the bottom of the box, and adapted lengthwise of the axis 10 thereof, to be abutted against the gland 30 at the top of the box when the flange 72 of the mold abuts against the rabbet 42 in the bottom housing member 22 of the box. Meanwhile, the O-ring 36 in the groove 46 provides a seal at the bottom of the box, and threaded holes 74 in the flange, adapted to register with the holes 48 in the box, enable the cap screws 50 to be used in securing the mold to the box.

The mold is also adapted so that when inserted in the box, that portion of it which occupies the gap 32, is slightly reduced in diameter at the outer peripheral surface 76 thereof, for more ready engagement with the crest 60 of the gland, and moreover, is ported at the surface 76 to provide for liquid coolant flow through the mold for the cooling function mentioned earlier. First, however, before describing these features, it will be seen that at its upper end, the mold has an annular rabbet 78 about the outer periphery thereof, which is rounded at the outside shoulder thereof, and less so at the inside shoulder, to provide abutments 80, 82 for engagement with the crests 58, 60 of the gland. In addition, the instep 84 (FIG. 2) of the rabbet opposes the swale 56 in the gland, so that when they are abutted, an annular clearance is formed between the two, the purposes for which will be explained more fully in connection with the system 18.

At the inner peripheral edge of its upper end, the mold is more widely and deeply rabbetted, and the rabbet 86 has threading 88 about the vertical wall thereof, and a slight unthreaded neck 90 about the top of the threading, to accommodate the top ring 64 and the retainer ring 66 assembly of the casting unit. The neck 90 also provides a clearance between the ring assembly and the rabbet 38 in the top housing member, to accommodate a further retainer means (not shown) for the scupper.

At the inner periphery of the rabbet 86, the mold is rabbetted again at 92, to form an annular step for a further O-ring 94 inserted between the mold and the refractory top ring, and that rabbet is rabbetted again at 96, and more deeply, to form an annular shoulder for the graphite ring. The graphite ring 16 is cylindrical, and at the inner peripheral surface thereof, is substantially equal in diameter to the inner peripheral surface 100 of the upper end portion of the mold. Both are sized at their inner peripheral surfaces, moreover, to correspond to the cross sectional area of the billet to be cast at the station, and together, they define the casting surface of the mold, at the upper cavity 12 therewithin.

Below the upper cavity 12, and at its inner periphery, the mold has three axially successive conical surfaces 102, 104, 106, which define an open ended lower cavity 108 in the mold, having a cross sectional configuration transverse the axis 10 of the mold, corresponding to that of the upper cavity 12, but greater in cross sectional area than that of the upper cavity so as to flare relatively outwardly from the axis in the direction relatively toward the lower end of the mold from the upper end thereof. This flare provides an annular clearance about the molten metal body as it emerges from the upper cavity of the mold, and as shall be explained, coolant water is discharged onto the molten metal body in this clearance to direct cool the body as it elongates along the axis of the mold.

The coolant is discharged at the uppermost 102 of the three surfaces, which forms a shallow dome-like mantle above the clearance, at a level adjacent that at which the molten metal body emerges from the upper cavity. However, as indicated earlier, the body "stands" on a stool cap as it elongates along the axis 10, and in a stage preliminary to the casting station, the stool cap must be telescopically engaged with the mold to take up support of the molten metal body. Therefore, to align the upper cavity 12 of the mold with the cap, and vice versa, the lowermost surface 106 of the lower cavity 108 has a set of lugs 110 monolithically outstanding thereon in the same material as the mold, to act as slideably engageable guides for the cap, and the lugs are angularly spaced about the axis of the mold to enable the coolant water to run between them when the molten metal body is first formed along the axis of the mold.

Returning to the surface 76 at the outer periphery of the mold, it will be seen that the mold has a series of ports 112 therein (FIG. 5) which are angularly spaced about the axis 10 of the mold and disposed in the upper end portion of the mold, at the outer periphery thereof, to interface with the chamber 14 of the box. The series of ports is formed by a circumferential groove 114 in the surface 76 of the mold, which has a series of mullions 20 angularly spaced thereabout, and monolithically axially upstanding therein, in the same material as the mold, to form the ports. The mullions 20 are also radially outwardly spaced from the bottom of the groove to leave an annular channel 116 about the axis 10 of the mold, between the mullions and the bottom of the groove. To discharge the coolant water into the lower cavity 108 of the mold from the groove 114, the mold has a series of closely spaced holes 118 in the inner peripheral portion thereof, which extend about the axis 10 of the mold in the domelike surface 102 thereof, and interconnect the channel 116 with the lower cavity of the mold at the upper end of the clearance provided by the flare of the canopy 102, 104, 106 thereabout. Because of the disposition of the groove 114 in the upper end portion of the mold, the series of holes 118 is also sharply downwardly angled to the axis of the mold, to sharply angle the coolant discharge impinging on the surface of the molten metal body. Meanwhile, the orifice-like size of the holes 118, reduces the discharge to a corresponding series of jets which achieve a faster quench on the surface of the molten metal body, and lend themselves to other functions in the way of altering the heat transfer characteristics of the coolant on the surface of the metal, as explained in U.S. Pat. Nos. 4,693,298, 5,040,595, and 5,119,883.

The mullions 20 are also inset from the outer peripheral surface 76 of the mold, and the groove 114 is rabbetted at the outer peripheral edges thereof, to form an annular seat 120 about the mouth of the groove for the baffle. The baffle is adapted to snap engage in the seat, and has a series of symmetrically spaced holes 122 thereabout, which meter the coolant flow into the groove for discharge into the holes 118, and then into the clearance 108 about the surface of the molten metal body.

Referring now to the fluid transmission system 19, it will be seen that the upper face 132 of the flange 72 forms an annulus with the rabbet 42 of the bottom housing member, where it abuts the same, and a fluid flow passage 124 is shown in the mold between that annulus and the outer periphery of the graphite ring 16, to represent one of the two fluid transmission systems normally provided for forcing oil and air through the ring in the manner of U.S. Pat. Nos. 4,598,763 and 4,947,925. The passage 124 comprises a vertical hole 126 which is drilled into the mold from the bottom end thereof, and directed axially upwardly of the mold to pass through one of the mullions 20 at the outer periphery thereof. The vertical hole 126 is then interconnected with the outer periphery of the graphite ring and the annulus, by a horizontal hole 128 drilled into the mold from the vertical wall of the rabbet 96, and an oblique hole 130 drilled into the mold from the annulus at the flange thereof. An annular seal such as an O-ring (not shown) is provided at the joint 134 between the rabbet 42 of the bottom housing member, and the upper face 132 of the flange, and a plug 135 is inserted in the bottom of the vertical hole 126, to close the passage 124 for the supply of pressurized fluid to the system 19 from a source 136 connected with the joint 134 through the bottom housing member of the box.

The fluid transmission system 18 also operates to discharge fluid from the mold, relatively outside thereof, but in the sense of relieving the mold of unintended leakage from the chamber of the box, rather than delivering fluid to a surface of the mold for intentional discharge therefrom for one of the functions described in the aforementioned Patents. Referring again to FIG. 3, it will be seen that the mold has an additional opening 142 therein, at the outer peripheral edge of the flange, and a fluid flow passage 138 therein which interconnects the step 84 of the rabbet 78 in the upper end of the mold, with the additional opening 142. The passage 138 comprises a second vertical hole 140 which is drilled upwardly in the mold from the bottom thereof, first through another of the mullions 20 at the outer periphery of the mold, and then into the step 84 of the rabbet 78 at the upper end of the mold. The vertical hole 140 intersects the additional opening 142 in the flange, and when unplugged at the bottom thereof, provides a discharge passage for any coolant water which leaks past the relatively outer seal 82, 60 between the outer abutment 60 on the upper end of the mold and the outer crest 82 of the elastomeric gland 30, before the leakage can penetrate the relatively inner seal between the abutment 58 of the mold and the crest 80 of the gland. However, when plugged at the bottom, the hole 140 provides a shunt for discharging the leakage at the opening 142, while a portion of the leakage is collected in the bottom of the hole, to signal to the operator the presence of leakage flow in the passage.

Referring now to FIGS. 7-15 in conjunction with FIG. 3, it will be seen that the bottom of the hole 140 has a socket 146 formed therein, and an elongated ball equipped receptacle-type leakage detection device 17 is mounted in the socket to depend relatively downwardly from the bottom of the mold, at the lower end portion 148 thereof. The device comprises a thimble-like receptacle 150 made of clear plastic or the like, which is transparent so as to reveal the contents of anything captured in the interior of the exposed lower end portion 148 of the receptacle. The receptacle also has a neck 152 thereabout, at the lower end portion thereof, to provide a grip for insertion and removal of the device from the socket; but thereabove, the main body or shank 154 of the receptacle is cylindrical at the outer periphery thereof, to telescopically engage in the socket 146 when inserted therein. The diameter of the shank is reduced slightly, however, to provide a flange 156 for abutment with the bottom of the mold; and shortly thereabove, there is a circumferential groove 158 about the shank, and a shallower groove 160 in the wall of the socket, to accommodate an elastomeric ring 162 seated in the groove 158 of the device and detachably engageable with the mold at the groove 160 thereof, to removably secure the device to the mold.

Inside, the receptacle 150 has an elongated cylindrical bore 164 which extends within the exposed lower end portion 148 of the receptacle, but the bore is interrupted at its midsection, by a reduced diameter throat 166 which is square in cross section, transverse the longitudinal axis of the bore, and sized to provide a seat for a coated indicator ball 168 loosely received in the upper end portion of the bore. The ball 168 has a water soluble coating 170 about the spherical core 172 thereof, and with the coating thereon, the diameter of the core is such that it is held captive in the upper end portion of the bore by the side to side dimension of the throat 166, but without the coating, it is capable of passing through the throat between the sides thereof, such as when the coating is dissolved by leakage coolant in the bore from the passage 138 thereabove. Meanwhile, even before the coating is dissolved, the ball and throat define a clearance therebetween at each corner 174 of the throat, through which the leakage coolant can drip into the cavity 165 remaining at the bottom of the throat, in the exposed lower end portion 148 of the receptacle.

The device 17 is positioned below the juncture 144 between the holes 140, 142 of the passage, and therefore, receives the initial flow of leakage from the clearance between the rabbet 78 of the mold and the swale 56 of the elastomeric gland 30. During this time, before the leakage accumulates to the extent of spilling out the hole 142 in the flange, the coating 170 on the ball is subjected to dissolution by the coolant, even as the coolant drips into the cavity 165 of the exposed lower end portion 148 of the receptacle. Given a coating which is color producing in the coolant, therefore, the water which drips into the cavity 165 will appear through the transparent window provided by the clear plastic construction of the receptacle. Ultimately, when the coolant has dissolved the coating to such an extent that the core 172 of the ball is free to pass through the throat 166, then the core itself will also appear in the cavity of the receptacle as a solid object standing in the colored water therein. Of course, when the leakage rises above the level of the juncture 144, any excess leakage spills out the hole 142 in the flange, but prior to that time, an operator is likely to observe, first, the presence of the colored liquid in the cavity of the device, and then the core 172 itself, standing in that liquid as an indication of the more advanced stage to which leakage has occurred in the device. And as explained earlier, he can observe both of these stages even after the table has been tilted into an inclined position above the top of the pit, such as when, at a time prior to the casting operation, the operator has lowered the table over the pit, mated the stool with the lugs 110 of the respective stations, tested the table with pressurized coolant, and then raised the table once again for the viewing of it in the tilted up position thereof.

The receptacle-type leakage detection device seen in FIGS. 16 and 17 differs from that seen in FIGS. 7–15, in that the receptacle 176 of it has an open ended bore 178, the upper end 180 of which is threaded and the lower end 184 of which has a reduced diameter aperture 186 therein that opens to atmosphere and provides a "window" for the device. A piston 188 with an elongated but reduced diameter pin 190 on the forward end 192 thereof, is loosely received in the bore, and urged into engagement with the lower end 194 of the bore by a coiled spring 196 which is received in a socket 197 in the piston, and caged between the socket and a cap 198 threaded into the upper end 180 of the bore. The pin 190 loosely protrudes within the aperture 186, meanwhile, and when the piston abuts the lower end 194 of the bore, under the urging of the spring 196, the nose of the pin actually projects through and well beyond the aperture 186 to appear outside the lower end 184 of the receptacle. However, the pin has a sleeve 200 of water soluble material circumposed thereabout, between the forward end 192 of the piston and the lower end 194 of the bore, and the cap 198 in the upper end 180 of the bore has an open faced spider mounted core 202 therewithin for the spring, so that water from the juncture 144 of the passage 138 can pass through the cap and move along the annulus 204 about the piston, to attack the sleeve 200 between the piston and the lower end of the bore. Commonly, the water soluble material is granular and sufficiently water penetratable that the leakage can escape through the annulus 206 between the pin and the aperture 186 of the receptacle while the sleeve is undergoing dissolution. Again, given a color producing water soluble material, this leakage at the "window" 186 of the receptacle will be apparent to an operator of the apparatus, but ultimately, when the sleeve 200 has been dissolved, the bias of the spring 196 will force the piston against the lower end 194 of the bore and project the full length of the nose of the pin beyond the window, to signal the more advanced stage of leakage flow to the operator.

Once again, the receptacle has a neck 208 thereabout as a grip, and an elastomeric O-ring 210 thereabout for interengagement between the receptacle and the body of the mold, at the socket 146 therein. Also, so that the sleeve 200 can be replenished when desired, the receptacle has a threaded port 212 in the neck thereof, and a flat headed screw 214 is threaded into the port, and countersunk below the outer periphery of the receptacle, for removal from the receptacle when it is desired to recharge the bore with a new sleeve, the piston meanwhile being retracted against the bias of the spring by depressing the nose of the pin 190 into the aperture 186 at the lower end 184 of the receptacle.

In still another receptacle-type leakage detection device (not shown), the receptacle has a plain cylindrical vertical bore therein, terminating in a window at the bottom thereof, which is of the same diameter as that of the bore, and open to atmosphere, like that seen at 186 in the device of FIGS. 16 and 17, but the window is large enough to contain a plug which is detachably engaged in it from a point therebelow, outside of the device, and is of changeable color, so as to change color to, say, bright red, when sensitized by exposure to liquid coolant in the bore of the receptacle thereabove.

Figure 6:
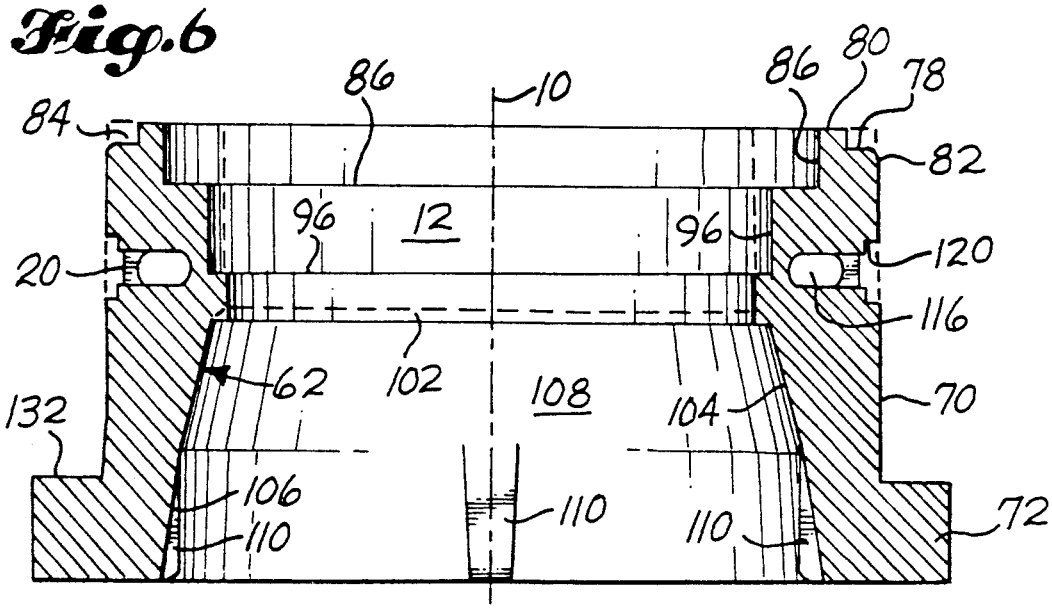
FIG. 6 is a vertical cross section of the annular mold employed in making up the metal casting unit, taken at the axis of the mold, and at the time the mold was first cast or otherwise formed for use in making up the metal casting unit.

The mold may be formed as a monolithic body of mold forming material, which is annular in shape and has no more features than those shown in the dashed outline of FIG. 6. That is, the monolithic body may have upper and lower ends, the aperture 12, 108 between the ends thereof on the mold body axis 10, the annular flange 72 relatively outturned about the axis thereof, at the outer periphery thereof, the set of lugs 110 about the axis thereof on the lower end portion of the mold body, and the circumferential groove 114 about the outer periphery thereof in the upper end portion of the mold body, with the mullions 20 upstanding therein. Then, given this intermediate product with which to work, a machinist can machine the various rabbets, holes, chamfers, and the like in and from the monolithic body, to form the mold body seen in the remaining Figures. Thereafter, before anything else is added, the graphite ring can be heat shrunk into its seat on the shoulder 76 of the mold body; and finally, the remaining elements of the casting unit can be added to the mold body, to complete the unit. Commonly, they are added by slipping the baffle 68 about the mold body until it snap engages in the seat 120 for the same, and then adding the graphite ring 16, the O-ring 94, and the top ring and retainer ring assembly, to the upper end of the mold body. For this purpose, the graphite ring has a height flush with the rabbet 86 of the mold body at the inner periphery thereof, so that the O-ring 94 is captured between the graphite ring and the mold body, at the step 92; and in addition, it has a rabbet 216 at the upper inner peripheral edge thereof, within which a corresponding rabbet 218 in the lower outer peripheral edge of the refractory top ring 64, can mate with the graphite ring. Meanwhile, the inner periphery of the top ring is sized and slightly conical, to engage about the bottom end portion of the scupper 8, and the top ring 64 and the retainer ring 66 are mitered at the opposing upper and lower outer peripheral and inner peripheral corners 220, 222 thereof, to enable the top ring to be clamped to the top of the mold body, by threading the retainer ring into the rabbet 86 at the upper end of the mold body.

Commonly, the retainer ring 66 has a set of sockets (not shown) in the upper surface thereof, to receive a spanner wrench with which to thread the ring into the mold in this latter operation.

When the casting unit is to be installed, the gland 30 is seated in the groove 40 of the top housing member, the screen 34 is inserted in the gap 32 and then seated about the gap at the seats 52, 54 for the same, and then the casting unit 6 is upwardly inserted in the gap until the rabbetted upper end of the mold body abuts the gland at the crests 80,82 thereof, and the flange 72 of the mold body abuts the bottom housing member at the rabbet 42 therein. The refractory top ring 64, meanwhile, engages about the scupper 8, and may have means (not shown) inserted therebetween to aid in forming a refractory seal between the two.

Figure 4:
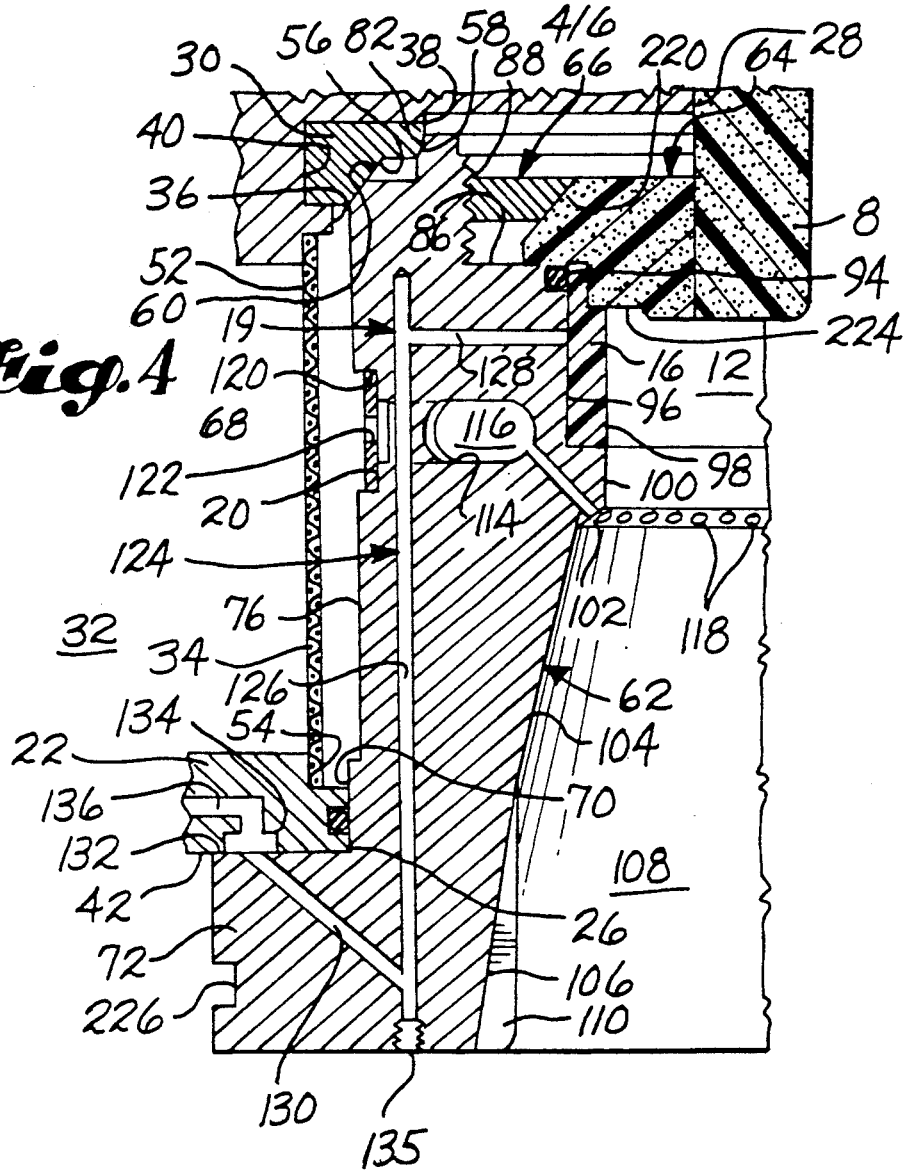
FIG. 4 is a vertical cross section of the casting station along the line 4—4 of FIG. 1.

To aid in forming a pocket for the annulus of gas formed around the molten metal body as it takes shape in the cavity 12 of the mold, the bottom of the top ring is often relieved at the outer peripheral edge portion 224 thereof, as seen in FIG. 4.

To aid in withdrawing the casting unit from the table, the mold is commonly equipped with a further circumferential groove 226 about the outer peripheral edge of the flange, so that a mechanical grab (not shown) can be employed to take a better grip on the mold in the process of withdrawing the unit.

The intermediate product seen in FIG. 6 may be formed by any one of several conventional processes, including that of casting it in a permanent mold (not shown) having a heat reducible filler enclosed therewithin for the groove, and that of forming it by the lost foam technique which is widely used today in other technologies. Alternatively, the intermediate product may be formed by machining a block of metal or the like until it has the necessary character and configuration, including the groove 114 and the mullions 20 therein, but this is the least desirable technique, since it defeats many of the advantages provided by the invention.

We claim:

1. In a molten metal casting apparatus of the type wherein an annular metal casting unit is supported in an aperture in a casting table to form an open ended metal casting station thereon through which the molten metal to be cast is poured along a vertical axis of the table and cast into a molten metal body, and wherein during the casting procedure, the casting station has a stool operatively disposed therebelow on the axis of the table to telescopically engage with the bottom of the casting unit at a stage preliminary to the casting operation, and then in the operation itself, to provide a relatively retractable support for the molten metal body as it progressively emerges from the unit and elongates along the axis of the table, and wherein moreover, the metal casting unit has an opening formed therein about the molten metal body, and means formed thereabout in the apparatus for discharging liquid coolant through the opening to direct cool the molten metal body as it emerges from the unit and elongates along the axis of the table, the improvement wherein the metal casting unit comprises an annular mold which is formed as a monolithic body of mold forming material having a vertical axis, upper and lower ends, an aperture between the ends thereof on the mold body axis, and an annular flange which is relatively outturned about the mold body axis, and monolithically outstanding in the same material at the outer periphery of the mold body, the mold body is telescopically inserted in the aperture of the table coaxially thereof, to form the casting station, and is abutted against the table at the flange thereof, to receive support from the table, the mold body has angularly spaced guide means about the axis thereof, which are monolithically outstanding in the same material on the lower end portion of the mold body in the aperture thereof, to mate with the stool in the stage preliminary to the casting operation, the mold body has angularly spaced ports about the axis thereof, which are recessed in the outer periphery of the mold body to interface with the liquid coolant discharge means, and to open into the aperture of the mold body between the guide means and the upper end portion of the mold body during the casting operation, so that the liquid coolant discharges through the ports into the lower end portion of the mold body to direct cool the molten metal body as it emerges from the upper end portion of the mold body and elongates along the axis thereof, and the mold body is engaged with the table in an annulus about the axis of the table, the annulus has a fluid supply connection thereacross between the mold body and the table, and the mold body has an additional opening in one end portion thereof, and a fluid flow passage therewithin which is interconnected between the fluid supply connection and the additional opening to transmit fluid to the additional opening from the connection for discharge from the mold body, relatively outside thereof.

2. The molten metal casting apparatus according to claim 1 wherein the annulus is formed about the axis of the table at the abutment interface between the flange and the table.

3. The molten metal casting apparatus according to claim 1 wherein the ports are defined by outer peripheral portions of the mold body which monolithically upstand in the same material between the upper and lower end portions of the mold body, generally axially thereof, and the fluid flow passage extends through one of the port defining outer peripheral portions of the mold body, axially thereof.

4. The molten metal casting apparatus according to claim 1 wherein the mold body has an annular rabbet about the inner periphery thereof at the upper end thereof, the additional opening is formed in the axially extending wall of the rabbet, and the metal casting unit further comprises a ring of graphite or the like which is seated in the rabbet so that the fluid transmitted through the passage can be forced therethrough in the direction of the axis of the mold body, to form an annulus of fluid about the molten metal body as it is cast within the aperture of the mold body.

5. The molten metal casting apparatus according to claim 1 wherein the liquid coolant discharge means take the form of a liquid coolant box, the housing of which defines the table and has spaced top and bottom housing members therein, which in turn have a pair of mutually opposing top and bottom apertures therein about a vertical axis of the box, and a chamber in the space between the members for supplying liquid coolant to the casting unit, and wherein the flange is monolithically outstanding in the same material on one end portion of the mold body at the outer periphery thereof, the mold body is telescopically inserted in the chamber through the aperture in one of the housing members, and abutted against the one housing member at the flange thereof, and against the other housing member about the aperture therein, so that in forming the casting station, the mold body interfaces with the chamber at the ports in the outer periphery thereof, for the discharge of the chamber coolant therethrough.

6. The molten metal casting apparatus according to claim 5 wherein the flange is monolithically outstanding in the same material on the lower end portion of the mold body at the outer periphery thereof, the mold body is telescopically inserted in the chamber through the bottom aperture of the box, and abutted against the bottom housing member at the flange thereof, and against the top housing member at the upper end portion thereof, and the fluid supply connection is formed in the abutment interface between the upper end portion of the mold body and the top housing member of the box.

7. The molten metal casting apparatus according to claim 6 wherein the additional opening is formed in the lower end portion of the mold body, and the abutment interface between the upper end portion of the mold body and the top housing member of the box has a pair of annular seals formed thereabout in circumferentially extending lines of the interface which are relatively radially spaced apart from one another about the axis of the box and relatively offset from one another axially of the box, with the fluid supply connection interposed therebetween to intercept any liquid coolant which leaks from the chamber past the relatively radially outer seal of the interface in the direction of the axis of the box, and discharge the leakage coolant in the direction of the additional opening before the leakage coolant can penetrate the relatively inner seal of the interface.

8. The molten metal casting apparatus according to claim 7 wherein the mold body has an annular rabbet about the outer periphery thereof at the upper end thereof, to form a pair of annular shoulders about the rabbet and the upper end of the mold body, and the top housing member of the box has an annular seal of elastomeric material circumposed about the axis thereof adjacent the top aperture therein, which is engaged with the annular shoulders about the rabbet and the upper end of the mold body, to form the pair of annular seals about the interface between the upper end portion of the mold body and the top housing member of the box, the elastomeric seal having an annular swale about the inner periphery thereof, at the lower end thereof, to leave an annular clearance between the elastomeric seal and the step of the rabbet, and the fluid supply connection being formed in the step of the rabbet opposite the swale to intercept liquid coolant which leaks across the seal between the elastomeric seal and the shoulder of the rabbet, before the leakage can penetrate the seal between the elastomeric seal and the shoulder on the upper end of the mold body.

9. The molten metal casting apparatus according to claim 5 wherein the box has an annular screen circumposed about the axis thereof at the outer periphery of the casting station, to screen the liquid coolant discharging through the ports of the mold body from the chamber of the box.

10. The molten metal casting apparatus according to claim 5 wherein the metal casting unit further comprises an annular baffle which is sleeved about the series of ports in the mold body and has a series of holes symmetrically arrayed thereabout to meter the coolant flow into the ports from the chamber.

11. In a molten metal casting apparatus of the type wherein an annular metal casting unit is supported in an aperture in a casting table to form an open ended metal casting station thereon through which the molten metal to be cast is poured along a vertical axis of the table and cast into a molten metal body, and wherein during the casting procedure, the casting station has a stool operatively disposed therebelow on the axis of the table to telescopically engage with the bottom of the casting unit at a stage preliminary to the casting operation, and then in the operation itself, to provide a relatively retractable support for the molten metal body as it progressively emerges from the unit and elongates along the axis of the table, and wherein moreover, the metal casting unit has an opening formed therein about the molten metal body, and means formed thereabout in the apparatus for discharging liquid coolant through the opening to direct cool the molten metal body as it emerges from the unit and elongates along the axis of the table, the improvement wherein the metal casting unit comprises an annular mold which is formed as a monolithic body of mold forming material having a vertical axis, upper and lower ends, an aperture between the ends thereof on the mold body axis, and an annular flange which is relatively outturned about the mold body axis, and monolithically outstanding in the same material at the outer periphery of the mold body, the mold body is telescopically inserted in the aperture of the table coaxially thereof, to form the casting station, and is abutted against the table at the flange thereof, to receive support from the table, the mold body has annular surfaces extending about the axis thereof at the inner peripheries of the upper and lower end portions of the mold body, respectively, which define an open ended upper cavity in the aperture thereof, having a cross sectional configuration in first planes transverse the axis of the mold body corresponding to the cross sectional configuration of the molten metal body to be cast therein, and an open ended lower cavity in the aperture of the mold body, having a cross sectional configuration in second planes transverse the axis of the mold body corresponding to the cross sectional configuration of the upper cavity, but greater in cross sectional area than that of the upper cavity in each of said second planes so as to provide an annulus of open air about the molten metal body as it emerges from the upper cavity and elongates along the axis of the mold body in the lower cavity, the mold body has guide means which are angularly spaced about the axis thereof, and monolithically outstanding in the same material on the lower end portion of the mold body in the lower cavity of the aperture therein, to mate with the stool in the stage preliminary to the casting operation, the mold body has a series of closely spaced holes in the inner peripheral portion thereof, which are generally symmetrically arrayed about the axis of the mold body to terminate at the inner periphery thereof and open into the lower cavity in the aperture of the mold body between the guide means and the upper cavity in the aperture of the mold body, the mold body has an annular passage therein which extends about the axis of the mold body and opens into the series of holes, and the mold body has a series of angularly spaced ports arrayed about the axis thereof, which are recessed in the mold body at the outer periphery thereof to interface with the liquid coolant discharge means, and which open into the annular passage in the mold body to discharge the liquid coolant into the annulus through the series of holes and direct cool the molten metal body when it has emerged from the upper cavity in the aperture of the mold body and is elongating along the axis thereof.

12. The molten metal casting apparatus according to claim 11 wherein the mold body has an annular surface extending about the outer periphery thereof which interfaces with the liquid coolant discharge means, and a circumferential groove in said outer peripheral surface which has a series of mullions therein that are angularly spaced about the groove and axially upstanding therein of the same material, to form the ports, the mullions being radially outwardly spaced from the bottom of the groove, to leave an annular channel about the axis of the mold body between the mullions and the bottom of the groove, which channel opens into the series of holes in the inner peripheral portion of the mold body.

13. The molten metal casting apparatus according to claim 12 wherein the groove is formed in the upper end portion of the mold body and the series of holes is sharply angled downwardly therefrom in the general direction of the axis of the mold body.

14. The molten metal casting apparatus according to claim 11 wherein the mold body has a first annular surface extending about the outer periphery thereof which interfaces with the liquid coolant discharge means, and second and third annular surfaces which extend about the axis of the mold body at the inner peripheries of the upper and lower end portions of the mold body, respectively, the second of which annular surfaces extends generally parallel to the axis of the mold body and defines the open ended upper cavity in the aperture thereof, and the third of which annular surfaces defines the open ended lower cavity in the aperture of the mold body, the cross sectional configuration of the lower cavity in said second planes of the mold body flaring relatively outwardly from the axis of the mold body in the direction relatively toward the lower end thereof from the upper end thereof, to form a progressively enlarged annulus of open air about the molten metal body it emerges from the upper cavity and elongates along the axis of the mold body in the lower cavity, the guide means taking the form of a set of angularly spaced lugs which are monolithically outstanding on the third annular surface in the same material, to mate with the stool in the stage preliminary to the casting operation, and the series of ports being formed by a circumferential groove in the outer peripheral portion of the mold body at the first annular surface thereof, which has a series of mullions that are angularly spaced about the groove and axially upstanding therein of the same material, to form the ports.

15. The molten metal casting apparatus according to claim 14 wherein the mullions are radially outwardly spaced from the bottom of the groove, to leave an annular channel about the axis of the mold body between the mullions and the bottom of the groove, which opens into the series of holes.

16. The molten metal casting apparatus according to claim 15 wherein the groove is formed in the upper end portion of the mold body, and the series of holes is sharply angled downwardly therefrom in the general direction of the axis of the mold body.

17. The molten metal casting apparatus according to claim 14 wherein the first and second annular surfaces of the mold body are cylindrical, and the third annular surface thereof is comprised of an axially extending series of conical sections, the uppermost of which has the series of closely spaced holes opening therein, and the lowermost of which has the set of angularly spaced lugs monolithically outstanding thereon.

18. In a molten metal casting apparatus wherein an annular metal casting unit with an annular flange relatively outturned thereabout, is inserted in a liquid coolant box to form an open ended metal casting station about a vertical axis of the box, the box has top and bottom plate-like housing members, a chamber for the liquid coolant between the housing members, and mutually opposing top and bottom apertures in the members on the axis, the annular casting unit is telescopically inserted in the chamber through the bottom aperture in the box, abutted against the bottom housing member at the flange thereof, and engaged with the top housing member in an annulus about the top aperture therein, and means are provided in the annulus to provide a pair of annular seals thereabout in circumferentially extending lines of the annulus which are relatively radially spaced apart from one another about the axis of the box and relatively offset from one another axially of the box, the improvement wherein:

the metal casting unit has an opening in the lower end portion thereof, a port in the upper end portion thereof which opens into the annulus between the annular seals formed thereabout, and a fluid flow passage therein which is interconnected between the port and the opening to discharge to the opening, liquid coolant that leaks from the chamber past the relatively radially outer seal of the annulus in the direction of the axis of the box, before the leakage coolant can penetrate the relatively radially inner seal of the annulus.

19. The metal casting apparatus according to claim 18 wherein that inner peripheral edge portion of the top housing member which defines the top aperture therein, forms a cover over the port, so that molten metal cannot penetrate the annulus and contaminate the metal casting unit.

20. The metal casting apparatus according to claim 18 wherein the metal casting unit has an annular rabbet about the outer periphery thereof, at the upper end thereof, to form a pair of annular shoulders about the rabbet and the upper end of the casting unit, and the top housing member of the box has an annular seal of elastomeric material circumposed about the axis thereof adjacent the top aperture therein, which engages with the annular shoulders about the rabbet and the upper end of the casting unit, to form a pair of annular seals about an annulus between the upper end portion of the casting unit and the top housing member of the box, and wherein the elastomeric seal has an annular swale about the inner periphery thereof, at the lower end thereof, to leave an annular clearance between the elastomeric seal and the step of the rabbet, and the port of the casting unit is formed in the step of the rabbet opposite the swale to intercept liquid coolant which leaks across the seal between the elastomeric seal and the shoulder of the rabbet, before the leakage can penetrate the seal between the elastomeric seal and the shoulder on the upper end of the casting unit.

21. The metal casting apparatus according to claim 18 further comprising leakage coolant detection means in the casting station for sensing the presence of leakage coolant flow in the passage of the casting unit, and communicating the same to an operator of the apparatus.

22. The metal casting apparatus according to claim 21 wherein the leakage coolant detection means include a leakage coolant receptacle which is mounted on the apparatus adjacent the casting station, and has a transparent window therein which is exposed relatively outside of the apparatus for viewing by an operator thereof, means which define a shunt in the passage for sidetracking a portion of the leakage coolant flow to the receptacle, and indicator means whereby the presence of the sidetracked portion of the leakage coolant flow in the receptacle is made visually apparent to the operator through the window of the receptacle.

23. The metal casting apparatus according to claim 22 wherein the indicator means include means of changeable color which are interactive with the sidetracked portion of the leakage coolant flow to change color in the window of the receptacle.

24. The metal casting apparatus according to claim 23 wherein the changeable color means are liquid coolant soluble, to dissolve in the sidetracked portion of the leakage coolant when interacting with the same.

25. The metal casting apparatus according to claim 22 wherein the receptacle has an axis, a bore of predetermined diameter with opposing ends which are disposed on the axis of the receptacle, and relatively proximal to and remote from the shunt, respectively, and a relatively reduced diameter throat which is disposed in the relatively remote end of the bore transverse the axis of the receptacle and opens onto the window of the receptacle, and wherein the proximal end of the bore is connected with the shunt to receive the sidetracked portion of the leakage coolant flow, and the indicator means are disposed in the bore and responsive to the presence of the sidetracked portion of the leakage coolant flow therein, to pass through the throat and appear at the window of the receptacle.

26. The metal casting apparatus according to claim 25 wherein the indicator means include means of changeable color which are interactive with the sidetracked portion of the leakage coolant flow, to pass through the throat and appear at the window of the receptacle with the flow.

27. The metal casting apparatus according to claim 26 wherein the changeable color means are liquid coolant soluble, to dissolve in the sidetracked portion of the flow when interacting therewith, and to flow through the throat with the sidetracked portion of the flow as an additive thereto.

28. The metal casting apparatus according to claim 25 wherein the receptacle has a portion thereof which projects relatively outside the apparatus on the axis of the receptacle, with the window therein for viewing by the operator of the apparatus, and the relatively projecting portion of the receptacle has a cavity therein on the opposite side of the throat from the bore to receive the indicator means when the same passes through the throat.

29. The metal casting apparatus according to claim 28 wherein the indicator means include a signaling device which is responsive to the presence of the sidetracked portion of the leakage flow in the bore, to pass through the throat and occupy the cavity of the receptacle for viewing by the operator through the window thereof.

30. The metal casting apparatus according to claim 25 wherein the receptacle has an end thereof which is exposed to the outside of the apparatus for viewing by the operator thereof, with the window therein, on the axis of the receptacle, the throat opens to atmosphere at the window of the receptacle, and the indicator means include a signaling device which is responsive to the presence of the sidetracked portion of the leakage coolant flow in the bore to project through the throat relatively outside the end of the receptacle at the window, for viewing by the operator.

31. The metal casting apparatus according to claim 25 wherein the indicator means include a signaling device which is movably disposed in the bore of the receptacle to pass through the throat in the direction of the window of the receptacle, and the leakage coolant detection means further comprise biasing means interposed between the signaling device and the proximal end of the bore, to urge the device along the axis of the receptacle in the direction of the window of the receptacle when the sidetracked portion of the leakage coolant flow is received in the bore, and restrainer means interposed between the signaling device and the remote end of the bore, to restrain the device from passing through the throat in the direction of the window of the receptacle when the bore is devoid of leakage, the restrainer means being soluble in the liquid coolant to dissolve therein when the leakage coolant flow is received in the bore, so that the biasing means can displace the signaling device along the axis of the receptacle to the extent that the device passes through the throat in the direction of the window of the receptacle.

32. The metal casting apparatus according to claim 31 wherein the receptacle has a portion thereof which projects relatively outside the apparatus on the axis of the receptacle, and on the opposite side of the throat from the bore, with a closed but transparent window therein for viewing by the operator of the apparatus, the relatively projecting portion of the receptacle has a cavity therein to receive the signaling device when the same passes through the throat, and the signaling device takes the form of a ball which is coated with a liquid coolant soluble material that operates to restrain it from passing through the throat when the bore is devoid of leakage coolant, but dissolves in the leakage coolant flow when the flow is received in the bore, to enable the ball to pass through the throat under the bias of the leakage coolant itself, and appear at the window of the receptacle in the cavity.

33. The metal casting apparatus according to claim 31 wherein the receptacle has an end thereof which is exposed to the outside of the apparatus on the axis of the receptacle, and on the opposite side of the throat from the bore, with the window therein for viewing by the operator of the apparatus, the throat opens to atmosphere at the window of the receptacle, the indicator means include a signaling device which is responsive to the presence of the sidetracked portion of the leakage coolant flow in the bore to project through the throat relatively outside the end of the receptacle at the window, for viewing by the operator, the signaling device takes the form of a piston which has a pin thereon that is disposed to project through the throat and appear at the window of the receptacle, and the leakage coolant detection means further comprise a spring caged between the piston and the proximal end of the bore, to urge the piston to pass the pin through the throat to the extent that the pin projects relatively outside the apparatus at the window of the receptacle, and a sleeve circumposed about the pin in the bore to restrain the piston from passing the pin through the throat to the aforesaid extent, the sleeve being soluble in the leakage coolant to dissolve and thereby allow the spring to displace the piston to the extent that the pin does pass through the throat and project relatively outside the apparatus at the window of the receptacle.

34. An annular mold for insertion in an aperture in a metal casting table to form an open ended molten metal casting station thereon through which the molten metal to be cast is poured along a vertical axis of the table and cast into a molten metal body, and wherein during the casting procedure, the casting station has a stool operatively disposed therebelow on the axis of the table to telescopically engage with the bottom of the mold at a stage preliminary to the casting operation, and then in the operation itself, to provide a relatively reciprocable support for the molten metal body as it progressively emerges from the mold and elongates along the axis of the table, and wherein moreover, the mold has an opening formed therein about the molten metal body, and means formed thereabout on the table for discharging liquid coolant through the opening to direct cool the molten metal body as it emerges from the mold and elongates along the axis of the table, comprising:

a monolithic body of mold forming material having a vertical axis, upper and lower ends, and an aperture between the ends thereof on the mold body axis, the mold body having an annular flange which is relatively outturned about the mold body axis, and monolithically outstanding in the same material at the outer periphery of the mold body to abut the table and receive support therefrom when the mold is inserted in the aperture of the table coaxially thereof, to form the station, the mold body having annular surfaces extending about the axis thereof at the inner peripheries of the upper and lower end portions of the mold body, respectively, which define an open ended upper cavity in the aperture thereof, having a cross sectional configuration in first planes transverse the axis of the mold body corresponding to the cross sectional configuration of the molten metal body to be cast therein, and an open ended lower cavity in the aperture of the mold body, having a cross sectional configuration in second planes transverse the axis of the mod body corresponding to the cross sectional configuration of the upper cavity, but greater in cross sectional area than that of the upper cavity in each of said second planes so that in the casting operation an annulus of open air is provided about the molten metal body as it emerges from the upper cavity and elongates along the axis of the mold body in the lower cavity, the mold body having guide means which are angularly spaced about the axis thereof, and monolithically outstanding in the same material on the lower end portion of the mold body in the lower cavity of the aperture therein, to mate with the stool in the stage preliminary to the casting operation, the mold body having a series of closely spaced holes in the inner peripheral portion thereof, which are generally symmetrically arrayed about the axis of the mold body to terminate at the inner periphery thereof and open into the lower cavity in the aperture of the mold body between the guide means and the upper cavity in the aperture of the mold body, the mold body having an annular passage therein which extends about the axis of the mold body and opens into the series of holes, and the mold body having a series of angularly spaced ports arrayed about the axis thereof, which are recessed in the mold body at the outer periphery thereof to interface with the liquid coolant discharge means during the casting operation, and which open into the annular passage in the mold body to discharge the liquid coolant into the annulus through the series of holes and direct cool the molten metal body when it has emerged from the upper cavity in the aperture of the mold body and is elongating along the axis thereof.

35. The annular mold according to claim 34 wherein the mold body has an annular surface extending about the outer periphery thereof which interfaces with the liquid coolant discharge means, and a circumferential groove in said outer peripheral surface which has a series of mullions therein that are angularly spaced about the groove and axially upstanding therein of the same material, to form the ports, the mullions being radially outwardly spaced from the bottom of the groove, to leave an annular channel about the axis of the mold body between the mullions and the bottom of the groove, which channel opens into the series of holes in the inner peripheral portion of the mold body.

36. The annular mold according to claim 35 wherein the groove is formed in the upper end portion of the mold body and the series of holes is sharply angled downwardly therefrom in the general direction of the axis of the mold body.

37. The annular mold according to claim 34 wherein the mold body has a first annular surface extending about the outer periphery thereof to interface with the liquid coolant discharge means, and second and third annular surfaces which extend about the axis of the mold body at the inner peripheries of the upper and lower end portions of the mold body, respectively, the second of which annular surfaces extends generally parallel to the axis of the mold body and defines the open ended upper cavity in the aperture thereof, and the third of which annular surfaces defines the open ended lower cavity in the aperture of the mold body, the cross sectional configuration of the lower cavity in said second planes of the mold body flaring relatively outwardly from the axis of the mold body in the direction relatively toward the lower end thereof from the upper end thereof, to form a progressively enlarged annulus of open air about the molten metal body as it emerges from the upper cavity and elongates along the axis of the mold body in the lower cavity, the guide means taking the form of a set of angularly spaced lugs which are monolithically outstanding on the third annular surface in the same material, to mate with the stool in the stage preliminary to the casting operation, and the series of ports being formed by a circumferential groove in the outer peripheral portion of the mold body at the first annular surface thereof, which has a series of mullions that are angularly spaced about the groove and monolithically axially upstanding therein of the same material, to form the ports.

38. The annular mold according to claim 37 wherein the mullions are radially outwardly spaced from the bottom of the groove, to leave an annular channel about the axis of the mold body between the mullions and the bottom of the groove.

39. The annular mold according to claim 37 wherein the groove is formed in the upper end portion of the mold body, and the series of holes is sharply angled downwardly therefrom in the general direction of the axis of the mold body.

40. The annular mold according to claim 37 wherein the first and second annular surfaces of the mold body are cylindrical, and the third annular surface thereof is comprised of an axially extending series of conical sections, the uppermost of which has the series of closely spaced holes opening therein, and the lowermost of which has the series of angularly spaced lugs monolithically outstanding thereon.

41. In an annular molten metal casting unit for insertion in an aperture in a metal casting table to form an open ended molten metal casting station thereon through which the molten metal to be cast is poured along a vertical axis of the table and cast into a molten metal body, and wherein during the casting procedure, the casting station has a stool operatively disposed therebelow on the axis of the table to telescopically engage with the bottom of the metal casting unit at a stage preliminary to the casting operation, and then in the operation itself, to provide a relatively reciprocable support for the molten metal body as it progressively emerges from the metal casting unit and elongates along the axis of the table, and wherein moreover, the metal casting unit has an opening formed therein about the molten metal body, and means formed thereabout on the table for discharging liquid coolant through the opening to direct cool the molten metal body as it emerges from the metal casting unit and elongates along the axis of the table, an annular mold which is formed as a monolithic body of mold forming material having a vertical axis, upper and lower ends, an aperture between the ends thereof on the mold body axis, and an annular flange which is relatively outturned about the mold body axis, and monolithically outstanding in the same material at the outer periphery of the mold body, to abut the table and receive support therefrom when the metal casting unit is inserted in the aperture of the table coaxially thereof, to form the station, the mold body having annular surfaces extending about the axis thereof at the inner peripheries of the upper and lower end portions of the mold body, respectively, which define an open ended upper cavity in the aperture thereof, having a cross sectional configuration in first planes transverse the axis of the mold body corresponding to the cross sectional configuration of the molten metal body to be cast therein, and an open ended lower cavity in the aperture of the mold body, having a cross sectional configuration in second planes transverse the axis of the mold body corresponding to the cross sectional configuration of the upper cavity, but greater in cross sectional area than that of the upper cavity in each of said second planes so that in the casting operation an annulus of open air is provided about the molten metal body as it emerges from the upper cavity and elongates along the axis of the mold body in the lower cavity, the mold body having guide means which are angularly spaced about the axis thereof, and monolithically outstanding in the same material on the lower end portion of the mold body in the lower cavity of the aperture therein, to mate with the stool in the stage preliminary to the casting operation, the mold body having a series of closely spaced holes in the inner peripheral portion thereof, which are generally symmetrically arrayed about the axis of the mold body to terminate at the inner periphery thereof and open into the lower cavity in the aperture of the mold body between the guide means and the upper cavity in the aperture of the mold body, the mold body having an annular passage therein which extends about the axis of the mold body and opens into the series of holes, the mold body having a series of angularly spaced ports arrayed about the axis thereof, which are recessed in the mold body at the outer periphery thereof to interface with the liquid coolant discharge means during the casting operation, and which open into the annular passage in the mold body to discharge the liquid coolant into the annulus through the series of holes and direct cool the molten metal body when it has emerged from the upper cavity in the aperture of the mold body and is elongating along the axis thereof, and an annular baffle which is sleeved about the series of ports in the mold body and has a series of holes symmetrically arrayed thereabout to meter the coolant flow into the ports from the liquid coolant discharge means.

42. The annular molten metal casting unit according to claim 41 wherein the mold body has a first annular surface extending about the outer periphery thereof to interface with the liquid coolant discharge means, and second and third annular surfaces which extend about the axis of the mold body at the inner peripheries of the upper and lower end portions of the mold body, respectively, the second of which annular surfaces extends generally parallel to the axis of the mold body and defines the open ended upper cavity in the aperture thereof, and the third of which annular surfaces defines the open ended lower cavity in the aperture of the mold body, the cross sectional configuration of the lower cavity in said second planes of the mold body flaring relatively outwardly from the axis of the mold body in the direction relatively toward the lower end thereof from the upper end thereof, to form a progressively enlarged annulus of open air about the molten metal body as it emerges from the upper cavity and elongates along the axis of the mold body in the lower cavity, the guide means taking the form of a set of angularly spaced lugs which are monolithically outstanding on the third annular surface in the same material, to mate with the stool in the stage preliminary to the casting operation, and the series of ports being formed by a circumferential groove in the outer peripheral portion of the mold body at the first annular surface thereof, which has a series of mullions that are angularly spaced about the groove and monolithically axially upstanding therein of the same material, to form the ports, the mold body having an annular rabbet about the groove, at the outer peripheral edges thereof, and the annular baffle being seated in the rabbet.

43. In an annular molten metal casting unit for insertion in an aperture in a metal casting table to form an open ended molten metal casting station thereon through which the molten metal to be cast is poured along a vertical axis of the table and cast into a molten metal body, and wherein during the casting procedure, the casting station has a stool operatively disposed therebelow on the axis of the table to telescopically engage with the bottom of the metal casting unit at a stage preliminary to the casting operation, and then in the operation itself, to provide a relatively reciprocable support for the molten metal body as it progressively emerges from the metal casting unit and elongates along the axis of the table, and wherein moreover, the metal casting unit has an opening formed therein about the molten metal body, and means formed thereabout on the table for discharging liquid coolant through the opening to direct cool the molten metal body as it emerges from the metal casting unit and elongates along the axis of the table, an annular mold which is formed as a monolithic body of mold forming material having a vertical axis, upper and lower ends, an aperture between the ends thereof on the mold body axis, and an annular flange which is relatively outturned about the mold body axis, and monolithically outstanding in the same material at the outer periphery of the mold body, to abut the table and receive support therefrom when the metal casting unit is inserted in the aperture of the table coaxially thereof, to form the station, the mold body having angularly spaced guide means about the axis thereof, which are monolithically outstanding in the same material on the lower end portion of the mold body in the aperture thereof, to mate with the stool in the stage preliminary to the casting operation, angularly spaced ports about the axis thereof which are recessed in the outer periphery of the mold body to interface with the liquid coolant discharge means, and to open into the aperture of the mold body between the guide means and the upper end portion of the mold body during the casting operation, so that the liquid coolant can discharge through the ports to direct cool the molten metal body as it emerges from the upper end portion of the mold body and elongates along the axis thereof, a pair of first and second additional openings in the upper and lower end portions of the mold body, respectively, and a fluid flow passage in the mold body, which is interconnected between the first and second additional openings to transmit fluid from one additional opening to the other for discharge from the mold body, relatively outside thereof,

44. The annular molten metal casting unit according to claim 43 wherein the ports are defined by outer peripheral portions of the mold body which monolithically upstand in the same material between the upper and lower end portions of the mold body, generally axially thereof, and the fluid flow passage extends through one of the port defining outer peripheral portions of the mold body, axially thereof.

45. The annular molten metal casting unit according to claim 43 wherein the mold body has an annular rabbet about the inner periphery thereof at the upper end thereof, the first additional opening is formed in the axially extending wall of the rabbet, and the unit further comprises a ring of graphite or the like which is seated in the rabbet so that fluid transmitted in the passage to the first additional opening from the second additional opening, can be forced through the ring in the direction of the axis of the mold body, to form an annulus of fluid about the molten metal body as it is cast within the aperture of the mold body.

46. The annular molten metal casting unit according to claim 43 wherein the flange is monolithically outstanding in the same material on the lower end portion of the mold body at the outer periphery thereof, the mold body has an annular rabbet about the outer periphery thereof at the upper end thereof, to form a pair of annular shoulders about the rabbet and the upper end of the mold body, with which to form a pair of annular liquid coolant seals about the axis of the mold body when the metal casting unit is inserted in the aperture of the table, which seals are relatively radially spaced apart from one another about the axis of the mold body, and the first additional opening is disposed on the step of the rabbet between the pair of seals, to intercept liquid coolant which leaks across the relatively radially outer seal, and discharge the same in the direction of the second additional opening, before the leakage can penetrate the relatively radially inner seal.

47. In a molten metal casting apparatus having a pair of fluid flow openings therein and a fluid flow passage therebetween which is connected with the pair of openings to deliver liquid to one opening from the other, a device for detecting liquid flow in the passage comprising:

a liquid receptacle which is in communication with the passage, to receive a portion of the liquid flow therein, and has indicator means thereon including a transparent window which is exposed relatively outside of the apparatus for viewing by an operator thereof, so that the portion of liquid flow in the receptacle is made visually apparent to the operator through the window of the receptacle.

48. The molten metal casting apparatus according to claim 47 wherein the indicator means also include means of changeable color which are interactive with the portion of liquid flow to change color in the window of the receptacle.

49. The molten metal casting apparatus according to claim 47 wherein the receptacle has an axis, a bore of predetermined diameter with opposing ends which are disposed on the axis of the receptacle, and relatively proximal to and remote from the passage, respectively, and a relatively reduced diameter throat which is disposed in the relatively remote end of the bore transverse the axis of the receptacle and opens onto the window of the receptacle, and wherein the proximal end of the bore is connected with the passage to receive the portion of liquid flow therein, and the indicator means also include signaling means which are disposed in the bore and responsive to the presence of the portion of liquid flow therein, to pass through the throat and appear at the window of the receptacle.

50. The molten metal casting apparatus according to claim 49 wherein the signaling means include means of changeable color which are interactive with the portion of liquid flow, to pass through the throat and appear at the window of the receptacle with the flow.

51. The molten metal casting apparatus according to claim 49 wherein the receptacle has a portion thereof which projects relatively outside of the apparatus on the axis of the receptacle, with the window therein for viewing by the operator of the apparatus, and the relatively projecting portion of the receptacle has a cavity therein on the opposite side of the throat from the bore to receive the signaling means when the same pass through the throat.

52. The molten metal casting apparatus according to claim 49 wherein the receptacle has an end thereof which is exposed to the outside of the apparatus for viewing by the operator thereof, with the window therein, on the axis of the receptacle, the throat opens to atmosphere at the window of the receptacle, and the signaling means include a signaling device which is responsive to the presence of the portion of the liquid flow in the bore to project through the throat relatively outside the end of the receptacle at the window, for viewing by the operator.

* * * * *